US011214940B2

(12) United States Patent
Takahashi et al.

(10) Patent No.: US 11,214,940 B2
(45) Date of Patent: Jan. 4, 2022

(54) HYDRAULIC DRIVE SYSTEM FOR CONSTRUCTION MACHINE

(71) Applicant: Hitachi Construction Machinery Tierra Co., Ltd., Koka (JP)

(72) Inventors: Kiwamu Takahashi, Moriyama (JP); Taihei Maehara, Koka (JP); Takeshi Ishii, Hino-cho (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 311 days.

(21) Appl. No.: 16/492,409

(22) PCT Filed: Mar. 28, 2018

(86) PCT No.: PCT/JP2018/013015
§ 371 (c)(1),
(2) Date: Sep. 9, 2019

(87) PCT Pub. No.: WO2019/186841
PCT Pub. Date: Oct. 3, 2019

(65) Prior Publication Data

US 2021/0324609 A1 Oct. 21, 2021

(51) Int. Cl.
*E02F 9/22* (2006.01)
*F15B 15/20* (2006.01)
*F15B 11/16* (2006.01)

(52) U.S. Cl.
CPC ..... *E02F 9/2228* (2013.01); *E02F 9/2235* (2013.01); *F15B 11/165* (2013.01); (Continued)

(58) Field of Classification Search
CPC ..... E02F 9/2228; E02F 9/2235; F15B 11/165; F15B 11/167; F15B 2211/40561; F15B 2211/40569; F15B 2211/45
See application file for complete search history.

(56) References Cited

U.S. PATENT DOCUMENTS 5,129,230 A * 7/1992 Izumi ..... E02F 9/2235 60/452
5,285,642 A * 2/1994 Watanabe ..... F15B 11/165 60/452

(Continued)

FOREIGN PATENT DOCUMENTS

CN 102251996 A 11/2011
CN 202182071 U 4/2012

(Continued)

OTHER PUBLICATIONS

International Search Report (PCT/ISA/210) issued in PCT Application No. PCT/JP2018/013015 dated Jun. 12, 2018 (two pages).

(Continued)

*Primary Examiner* — F Daniel Lopez
*Assistant Examiner* — Matthew Wiblin
(74) *Attorney, Agent, or Firm* — Crowell & Moring LLP

(57) ABSTRACT

Even where the differential pressure across a directional control valve associated with each actuator is very small, flow dividing control of the plurality of directional control valves can be performed stable, and even where a demanded flow rate suddenly changes at the time of transition from composite action to single action or the like, a sudden change of the flow rate of hydraulic fluid to be supplied to each actuator is prevented to implement superior combined operability. Further, the meter-in loss of the directional control valves can be reduced to implement a high energy efficiency. To this end, a plurality of pressure compensating valves 7*a*, 7*b* and 7*c* for controlling such that the pressure in the downstream side of the meter-in opening of a plurality of directional control valves 6*a*, 6*b* and 6*c* becomes equal to the highest load pressure are individually arranged in the downstream side of meter-in openings of the plurality of directional control valves 6*a*, 6*b* and 6*c*, and demanded flow rates for the directional control valves 6*a*, 6*b* and 6*c* are (Continued)

calculated from input amounts of operation levers. Besides, the meter-in pressure loss of a predetermined directional control valve is calculated from the demanded flow rates for and meter-in opening areas of the directional control valves 6*a*, 6*b* and 6*c*, and the set pressure of the unloading valve 15 is controlled using the value of the meter-in pressure loss.

5 Claims, 21 Drawing Sheets

(52) U.S. Cl.
CPC ..... *F15B 11/167* (2013.01); *F15B 15/202* (2013.01); *F15B 2211/40561* (2013.01); *F15B 2211/40569* (2013.01); *F15B 2211/45* (2013.01)

(56) References Cited

U.S. PATENT DOCUMENTS

| | | | | |
|---|---|---|---|---|
| 5,307,631 | A * | 5/1994 | Tatsumi ..... | E02F 9/2228 60/452 |
| 10,215,198 | B2 | 2/2019 | Takahashi et al. | |
| 2002/0007631 | A1 | 1/2002 | Sato et al. | |
| 2006/0230753 | A1 | 10/2006 | Hesse et al. | |
| 2015/0377258 | A1 | 12/2015 | Takahashi et al. | |
| 2017/0037601 | A1 | 2/2017 | Takahashi et al. | |
| 2017/0067226 | A1* | 3/2017 | Takahashi ..... | F15B 13/024 |

FOREIGN PATENT DOCUMENTS

| | | | |
|---|---|---|---|
| CN | 102734247 | A | 10/2012 |
| CN | 104995412 | A | 10/2015 |
| CN | 105134695 | A | 12/2015 |
| CN | 105492780 | A | 4/2016 |
| CN | 106133333 | A | 11/2016 |
| CN | 206751322 | U | 12/2017 |
| EP | 2 977 620 | A1 | 1/2016 |
| JP | 5-187411 | A | 7/1993 |
| JP | 11-315805 | A | 11/1999 |
| JP | 2007-506921 | A | 3/2007 |
| JP | 2012-233551 | A | 11/2012 |
| JP | 2014-98487 | A | 5/2014 |
| JP | 2015-105675 | A | 6/2015 |
| WO | WO 2014/084213 | A1 | 6/2014 |

OTHER PUBLICATIONS

Japanese-language Written Opinion (PCT/ISA/237) issued in PCT Application No. PCT/JP2018/013015 dated Jun. 12, 2018 (three pages).

Chinese-language Office Action issued in Chinese Application No. 201880015251.3 dated Jul. 27, 2020 with English translation (13 pages).

International Preliminary Report on Patentability (PCT/IB/338 & PCT/IB/373) issued in PCT Application No. PCT/JP2018/013015 dated Oct. 8, 2020, including English translation of document C2 (Japanese-language Written Opinion (PCT/ISA/237), filed on Sep. 9, 2019) (six (6) pages).

English translation of document C1 (International Search Reported (PCT/ISA/210) previously filed on Sep. 9, 2019) issued in PCT Application No. PCT/JP2018/013015 dated Jun. 12, 2018 (one page).

* cited by examiner

HYDRAULIC DRIVE SYSTEM FOR CONSTRUCTION MACHINE

TECHNICAL FIELD

The present invention relates to a hydraulic drive system for a construction machine such as a hydraulic excavator that performs various works, and particularly to a hydraulic drive system for a construction machine that supplies hydraulic fluid delivered from one or more hydraulic pumps to a plurality of two or more actuators through two or more of a plurality of control valves to perform driving.

BACKGROUND ART

As a hydraulic drive system for a construction machine such as a hydraulic excavator, as disclosed, for example, in Patent Document 1, load sensing control for controlling the displacement of a hydraulic pump is widely utilized such that the differential pressure between the delivery pressure of a variable displacement hydraulic pump and the highest load pressure of a plurality of actuators is kept to a set value.

In Patent Document 2, a hydraulic drive system is disclosed which includes a variable displacement hydraulic pump, a plurality of actuators, a plurality of meter-in orifices that control the flow rate of hydraulic fluid to be supplied from the hydraulic pump to the plurality of actuators, a plurality of pressure compensating valves provided in the downstream of the plurality of meter-in orifices and a controller that controls the delivery flow rate of the hydraulic pump in response to a lever input of an operation lever device and adjusts the plurality of meter-in orifices in response to the lever input, in which the controller controls to fully open the meter-in orifice associated with the actuator having the highest load pressure on the basis of the lever input. In the hydraulic drive system, the plurality of pressure compensating valves provided in the downstream of the plurality of meter-in orifices control such that the pressure in the downstream side of the meter-in orifices becomes equal to the highest load pressure without using a differential pressure or LS differential pressure between the pump pressure and the highest load pressure.

In Patent Document 3, a drive system is proposed which includes a variable displacement hydraulic pump, a plurality of actuators, a plurality of adjustment valves that have a throttle action at individual intermediate positions thereof and supply hydraulic fluid delivered from the hydraulic pump to the plurality of actuators, an unloading valve provided on a hydraulic fluid supply line of the hydraulic pressure, a controller that controls the delivery flow rate of the hydraulic pump in response to a lever input of an operation lever device, and a pressure sensor that detects the delivery pressure of the hydraulic pump and the load pressure of at least one of the actuators, in which the controller controls the opening of an adjustment valve having a throttle action at an intermediate position thereof in response to the differential pressure between the delivery pressure of the hydraulic pump and the actuator load pressure detected by the pressure sensor. In the drive system, the set pressure of the unloading valve is set depending upon the highest load pressure of the actuators introduced in a closing direction of the unloading valve and a spring provided in the same direction, and the delivery pressure of the hydraulic pump is controlled so as not to exceed a value of the sum of the highest load pressure and the spring force.

PRIOR ART DOCUMENT

Patent Documents

Patent Document 1: JP-2015-105675-A
Patent Document 2: JP-2007-506921-T
Patent Document 3: JP-2014-98487-A

SUMMARY OF THE INVENTION

Problems to be Solved by the Invention

In such conventional load sensing control as disclosed in Patent Document 1, although a differential pressure called LS differential pressure between a delivery pressure or pump pressure of a hydraulic pump and a differential pressure of the highest load pressure, which is caused by a differential pressure across a meter-in opening of each main spool or flow rate control valve, is used for pump flow rate control and flow dividing control of the main spool by a pressure compensating valve, the LS differential pressure is meter-in loss itself and makes one factor that hinders high energy efficiency of the hydraulic system.

Although, in order to increase the energy efficiency of the hydraulic system, it is sufficient if the meter-in final opening of each main spool, namely, the meter-in opening area in full stroke of the main spool, is increased extremely to reduce the LS differential pressure, in current load sensing control, the LS differential pressure cannot be reduced extremely to zero or the like. The reason is such as described below.

The pressure compensating valve that performs flow dividing control of each main spool controls the opening of the main spool such that the differential pressure across the main spool becomes equal to the LS differential pressure. In the case where the meter-in final opening of the main spool is extremely great and the LS differential pressure becomes zero as described above, each pressure compensating valve adjusts the opening of the individual main spool such that the differential pressure across the main spool becomes zero. However, in this case, there is a problem that, since the target differential pressure for determining the opening of the pressure compensating valve becomes zero, the opening of the pressure compensating valve, namely, the position of the spool in the case where the pressure compensating valve is of the spool valve type but the lift amount of the poppet valve in the case where the pressure compensating valve is of the poppet valve type, is not determined uniquely and the pressure control of the pressure compensating valve becomes unstable, which causes hunting.

According to the structure of Patent Document 2, since the meter-in opening of the actuator having the highest load pressure is fully opening controlled, the LS differential pressure that is one of factors that obstruct increase of high energy efficiency in the conventional load sensing control can be eliminated and a hydraulic system in which the energy efficiency is high can be implemented.

Here, as the pressure compensating valve, two pressure compensating valves are available including a pressure compensating valve in which the differential pressure across the meter-in opening of each main spool is controlled so as to become equal to a fixed value determined in advance or to a differential pressure or LS differential pressure between the pump pressure and the highest load pressure and another pressure compensating valve that is arranged in the downstream side of the meter-in opening of each main spool and in which the pressure in the downstream side of the meter-in opening is controlled so as to become equal to the highest load pressure of the plurality of actuators without using the LS differential pressure. The former pressure compensating valve is generally called load sensing valve, and the pressure compensating valve disclosed in Patent Document 1 is applicable to this type. The latter pressure compensating valve is called flow sharing valve, and the pressure compensating valve disclosed in Patent Document 2 is applicable to this type. In any case, the pressure compensating value is combined with the load sensing control of the hydraulic pump and is called load sensing system as a whole.

In Patent Document 2, since the flow sharing valve in which the LS differential pressure is not used is used as the pressure compensating valve, the problem that control of the pressure compensating valve becomes unstable does not occur as in the case in which the LS differential pressure is reduced to zero in the load sensing control in which the load sensing valve is used as the pressure compensating valve as in Patent Document 1.

However, also the conventional technology disclosed in Patent Document 2 has such a problem as described below.

In particular, since a throttle orifice, namely, a meter-in opening, associated with the highest load pressure actuator is usually controlled to full opening, there is a case in which, for example, in such a case that, from a state in which an actuator having the highest load pressure and another actuator having a low load pressure are operated at the same time, operation of the actuator whose load pressure is lower is stopped suddenly, certain fixed time is required for decrease of the flow rate to be delivered from the limit of responsiveness in flow rate control of the hydraulic pump.

In such a case as just described, since the throttle orifice of the actuator having the highest load pressure is controlled to maximum opening, hydraulic fluid delivered from the hydraulic pump flows into the highest load pressure actuator without being throttled by the opening of the throttle orifice. Therefore, the speed of the highest load pressure actuator sometimes increases suddenly.

In the case where the operation lever of the highest load pressure actuator is in a full operation state and the working speed of the actuator is originally so high that a great flow amount is supplied, the influence on the behavior of the work machine is comparatively small. However, since, in the case where the operation lever of the highest load pressure actuator is in a half operated state, the original flow rate is low and the influence when the flow rate supplied to the actuator increases suddenly as described above cannot be ignored. Therefore, there is a case that an unpleasant shock is given to an operator of the work machine.

According to the structure of Patent Document 3, since hydraulic fluid supplied from the hydraulic pump in response to each lever input can be divided only by a plurality of adjustment valves without using the pressure compensating valve, the cost of the hydraulic system can be reduced.

Further, in Patent Document 3, since the opening of the plurality of adjustment valves is calculated and determined in an electronic controller from the target flow rate to each actuator set in response to an operation lever and the differential pressure between the pump pressure and the highest load pressure detected by the pressure sensor, such a problem that control of the pressure compensating valve becomes unstable as in the case in which the LS differential pressure is set to zero by conventional load sensing control does not occur.

However, the conventional technology disclosed in Patent Document 3 has such a problem as described below.

In particular, while an unloading valve is provided on a hydraulic fluid supply line from the hydraulic pump, the set pressure of the unloading valve is set by the highest load pressure and spring force.

On the other hand, since openings, namely, meter-in openings, of the plurality of adjustment valves depend upon the differential pressure between the pump pressure and the actuator load pressure and the target flow rate of each actuator set in response to each operation lever, the pump pressure sometimes increases by an amount corresponding to the pressure loss in the adjustment valve associated with the highest load pressure actuator with respect to the highest load pressure.

However, since the set pressure of the unloading valve is set only by the highest load pressure and the spring force as described above, for example, in the case where the pressure loss at the adjustment valve associated with the highest load pressure actuator is high as described above, there is a case in which the pump pressure exceeds the pressure set based on the highest load pressure and the spring force and the unloading valve is placed into an opening position, at which hydraulic fluid supplied from the hydraulic pump is discharged to the tank. Since the hydraulic fluid discharged by the unloading valve is useless bleed-off loss, the energy efficiency of the hydraulic system is sometimes lost.

On the other hand, it is possible to increase the spring force, namely, to increase the set pressure high, of the unloading valve so as to prevent such a situation that the pressure loss by the adjustment valve associated with the highest load pressure actuator becomes so high as to exceed the set pressure of the unloading valve to cause useless bleed-off loss. However, in this case, for example, in the case where, from a state in which two or more actuators are being operated at the same time, only the lever operation of one of the actuators is stopped suddenly, sudden increase of the pump pressure arising from a situation in which the flow rate reduction control of the hydraulic pump is not performed in time cannot be suppressed by the unloading valve. Therefore, similarly as in the case where Patent document 2 is used, an unpleasant shock to an operator sometimes occur.

It is an object of the present invention to provide a hydraulic drive system for a construction machine that includes a variable displacement hydraulic pump and supplies hydraulic fluid delivered by the hydraulic pump to a plurality of actuators through a plurality of control valves to drive the plurality of actuators, in which (1) even in the case where the differential pressure across a directional control valve associated with each actuator is very small, flow dividing control of the plurality of directional control valves can be performed in a stable state, (2) even in the case where a demanded flow rate suddenly changes at the time of transition from composite action to single action or the like, the bleed-off loss that hydraulic fluid is discharged uselessly from an unloading valve to a tank is suppressed to suppress decrease of the energy efficiency and besides sudden change of the actuator speed by a sudden change of the flow rate of the hydraulic fluid to be supplied to the actuator is prevented to suppress occurrence of an unpleasant shock thereby to implement superior combined operability, and (3) the meter-in loss of the directional control valve can be reduced to implement a high energy efficiency.

Means for Solving the Problems

In order to attain the object described above, according to the present invention, there is provided a hydraulic drive system for a construction machine, comprising: a variable displacement hydraulic pump; a plurality of actuators driven by hydraulic fluid delivered from the hydraulic pump; a control valve device that distributes and supplies the hydraulic fluid delivered from the hydraulic pump to the plurality of actuators; a plurality of operation lever devices that instruct driving directions and speeds of the plurality of actuators; a pump regulation device that controls a delivery flow rate of the hydraulic pump so as to deliver a flow rate according to input amounts of operation levers of the plurality of operation lever devices; an unloading valve that discharges the hydraulic fluid of a hydraulic fluid supply line of the hydraulic pump to a tank when a pressure of the hydraulic fluid supply line increases and exceeds a set pressure equal to a sum of a highest load pressure of the plurality of actuators and at least a target differential pressure; and a controller that controls the control valve device, wherein the control valve device includes: a plurality of directional control valves that are individually shifted by the plurality of operation lever devices and associated with the plurality of actuators to adjust driving directions and speeds of the respective actuators, and a plurality of pressure compensating valves arranged in downstream sides of the plurality of directional control valves for controlling pressures in downstream sides of meter-in openings of the plurality of directional control valves such that the pressures in downstream sides of meter-in openings of the plurality of directional control valves becomes equal to the highest load pressure, and the controller is configured to: calculate demanded flow rates for the plurality of actuators and meter-in opening areas of the plurality of directional control valves based on input amounts of the operation levers of the plurality of operation lever devices, calculate a meter-in pressure loss of a particular directional control valve among the plurality of directional control valves based on the meter-in opening areas and the demanded flow rates, and output the pressure loss as the target differential pressure to control the set pressure of the unloading valve.

Since the present invention is configured such that flow dividing control of the plurality of directional control valves is performed by using the plurality of pressure compensating values (flow sharing valves) arranged in downstream sides of the plurality of directional control valves for controlling pressures in downstream sides of meter-in openings of the plurality of directional control valves such that the pressures in the downstream sides of the meter-in openings of the plurality of directional control valves becomes equal to the highest load pressure, even in the case where the differential pressures, namely, the meter-in pressure losses, across the directional control valves associated with the individual actuators are very small, flow dividing control of the plurality of directional control valves can be performed stably.

Further, in the present invention, the controller is configured to calculate demanded flow rates for the plurality of actuators and meter-in opening areas of the plurality of directional control valves based on input amounts of the operation levers of the plurality of operation lever devices, calculate a meter-in pressure loss of a particular directional control valve among the plurality of directional control valves based on the meter-in opening areas and the demanded flow rates, and output the pressure loss as the target differential pressure to control the set pressure of the unloading valve.

Consequently, since the set pressure of the unloading valve is controlled to the value of the sum of the highest load pressure and at least the target differential pressure, which is equivalent to the meter-in pressure loss, in such a case that the meter-in opening of a directional control valve is throttled by a half operation of the operation lever of the particular directional control valve or a like operation, the set pressure of the unloading valve is controlled carefully in response to the pressure loss at the meter-in opening of the directional control valve. As a result, even in the case where the demanded flow rate changes suddenly at the time of transition from a combined action to a single operation or the like and the pump pressure increases suddenly due to insufficient responsiveness of pump flow rate control, bleed-off loss in which hydraulic fluid is discharged uselessly from the unloading valve to the tank can be suppressed to the minimum and reduction of the energy efficiency can be suppressed and besides a sudden change of the actuator speed by a sudden change of the flow rate of the supplied hydraulic fluid can be prevented to suppress occurrence of an unpleasant shock thereby implement superior combined operability.

Further, in the present invention, even in the case where the differential pressure across each of the directional control valves is very small as described above, flow dividing control of the plurality of directional control valves can be performed stably. Besides, since the set pressure of the unloading valve can be controlled carefully in response to the pressure loss at the meter-in opening of the directional control valve, it becomes possible to make the final meter-in opening of each of the directional control valves, namely, the meter-in opening area at a full stroke of the main spool, extremely great. Consequently, it is possible to reduce the meter-in loss and implement a high energy efficiency.

Advantages of the Invention

According to the present invention, the hydraulic drive system for a construction machine that includes a variable displacement hydraulic pump and supplies hydraulic fluid delivered by the hydraulic pump to a plurality of actuators through a plurality of control valves to drive the plurality of actuators (1) can perform flow dividing control of the plurality of directional control valves stably even in the case where the differential pressure across a directional control valve associated with each actuator is very small;

(2) can suppress, even in the case where a demanded flow rate suddenly changes at the time of transition from composite action to single action or the like and pump pressure increases suddenly due to insufficient responsiveness of pump flow rate control, the bleed-off loss that hydraulic fluid is discharged uselessly from the unloading valve to the tank is suppressed to the minimum to suppress decrease of the energy efficiency and besides sudden change of the actuator speed by a sudden change of the flow rate of the hydraulic fluid to be supplied to each actuator is prevented to suppress occurrence of an unpleasant shock thereby to implement superior combined operability, and (3) can reduce the meter-in loss of the directional control valve to implement a high energy efficiency.

MODES FOR CARRYING OUT THE INVENTION

In the following, embodiments of the present invention are described with reference to the drawings.

First Embodiment

A hydraulic drive system for a construction machine according to a first embodiment of the present invention is described with reference to FIGS. 1 to 15.

~Structure~

Figure 1:
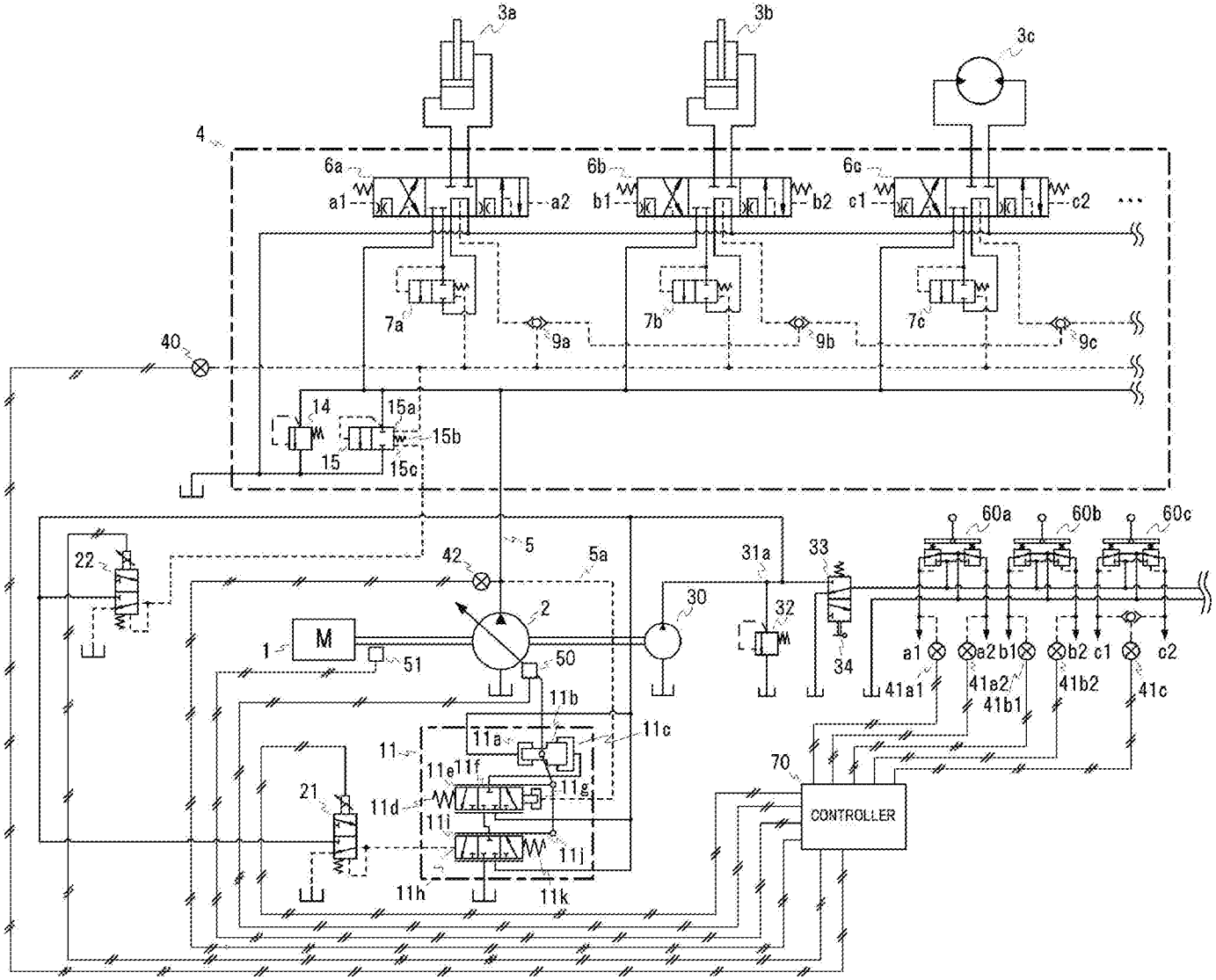
FIG. 1 is a view depicting a structure of a hydraulic drive system for a construction machine according to a first embodiment of the present invention.

FIG. 1 is a view depicting a structure of the hydraulic drive system for a construction machine according to the first embodiment of the present invention.

Referring to FIG. 1, the hydraulic drive system of the present embodiment includes a prime mover 1, a main pump 2 in the form of a variable displacement hydraulic pump driven by the prime mover 1, a pilot pump 30 of the fixed displacement type, a plurality of actuators driven by hydraulic fluid delivered from the main pump 2, a hydraulic fluid supply line 5, and a control valve block 4. The plurality of actuators include a boom cylinder 3*a*, an arm cylinder 3*b*, a swing motor 3*c*, a bucket cylinder 3*d* depicted in FIG. 4, a swing cylinder 3*e* depicted in FIG. 4, travelling motors 3*f* and 3*g* depicted in FIG. 4, and a blade cylinder 3*h* depicted in FIG. 4. The hydraulic fluid supply line 5 introduces hydraulic fluid delivered from the main pump 2 to the plurality of actuators 3*a*, 3*b*, 3*c*, 3*d*, 3*e*, 3*f*, 3*g* and 3*h*. The control valve block 4 is connected to the downstream of the hydraulic fluid supply line 5 such that hydraulic fluid delivered from the main pump 2 is introduced to the control valve block 4. In the following description, the "actuators, 3*a*, 3*b*, 3*c*, 3*d*, 3*e*, 3*f*, 3*g* and 3*h*" are represented in an abbreviated formed as "actuators 3*a*, 3*b*, 3*c*, . . . ."

In the control valve block 4, a plurality of directional control valves 6*a*, 6*b*, 6*c*, . . . for controlling the plurality of actuators 3*a*, 3*b*, 3*c*, . . . and a plurality of pressure compensating valves 7*a*, 7*b*, 7*c*, . . . positioned in the downstream side of the meter-in opening of the plurality of directional control valves 6*a*, 6*b*, 6*c*, . . . , respectively, are arranged. Each of the pressure compensating valves 7*a*, 7*b*, 7*c*, . . . has provided herein a spring for biasing the spool thereof in its closing direction. Besides, the pressure in the downstream side of the meter-in opening of the plurality of directional control valves 6*a*, 6*b*, 6*c*, . . . is introduced to the side to which the spools of the pressure compensating valves 7*a*, 7*b*, 7*c*, . . . are biased in the opening direction, and the highest load pressure Plmax of the plurality of actuators 3*a*, 3*b*, 3*c*, . . . hereinafter described is introduced to the side to which the spool of the pressure compensating valves 7*a*, 7*b*, 7*c*, . . . is biased to the closing direction.

The plurality of directional control valves 6*a*, 6*b*, 6*c*, . . . and the plurality of pressure compensating valves 7*a*, 7*b*, 7*c*, . . . configure a control valve device that distributes and supplies hydraulic fluid delivered from the main pump 2 to the plurality of actuators 3*a*, 3*b*, 3*c*, . . . .

Further, in the control valve block 4, in the downstream of the hydraulic fluid supply line 5, a relief valve 14 that discharges hydraulic fluid of the hydraulic fluid supply line 5 to a tank if the pressure in the hydraulic fluid supply line 5 becomes equal to or higher than a set pressure determined in advance and an unloading valve 15 that discharges hydraulic fluid in the hydraulic fluid supply line 5 to the tank if pressure in the hydraulic fluid supply line 5 becomes equal to or higher than a certain set pressure are provided.

Further, in the control valve block 4, shuttle valves 9*a*, 9*b*, 9*c*, . . . connected to the load pressure detection port of the plurality of directional control valves 6*a*, 6*b*, 6*c*, . . . are arranged. The shuttle valves 9*a*, 9*b*, 9*c*, . . . are provided for detecting the highest load pressure of the plurality of actuators 3*a*, 3*b*, 3*c*, . . . and configures a highest load pressure detection device. The shuttle valves 9*a*, 9*b*, 9*c*, . . . are connected in a tournament fashion, and the highest load pressure is detected at the shuttle valve 9*a* of the top level.

Figure 2:
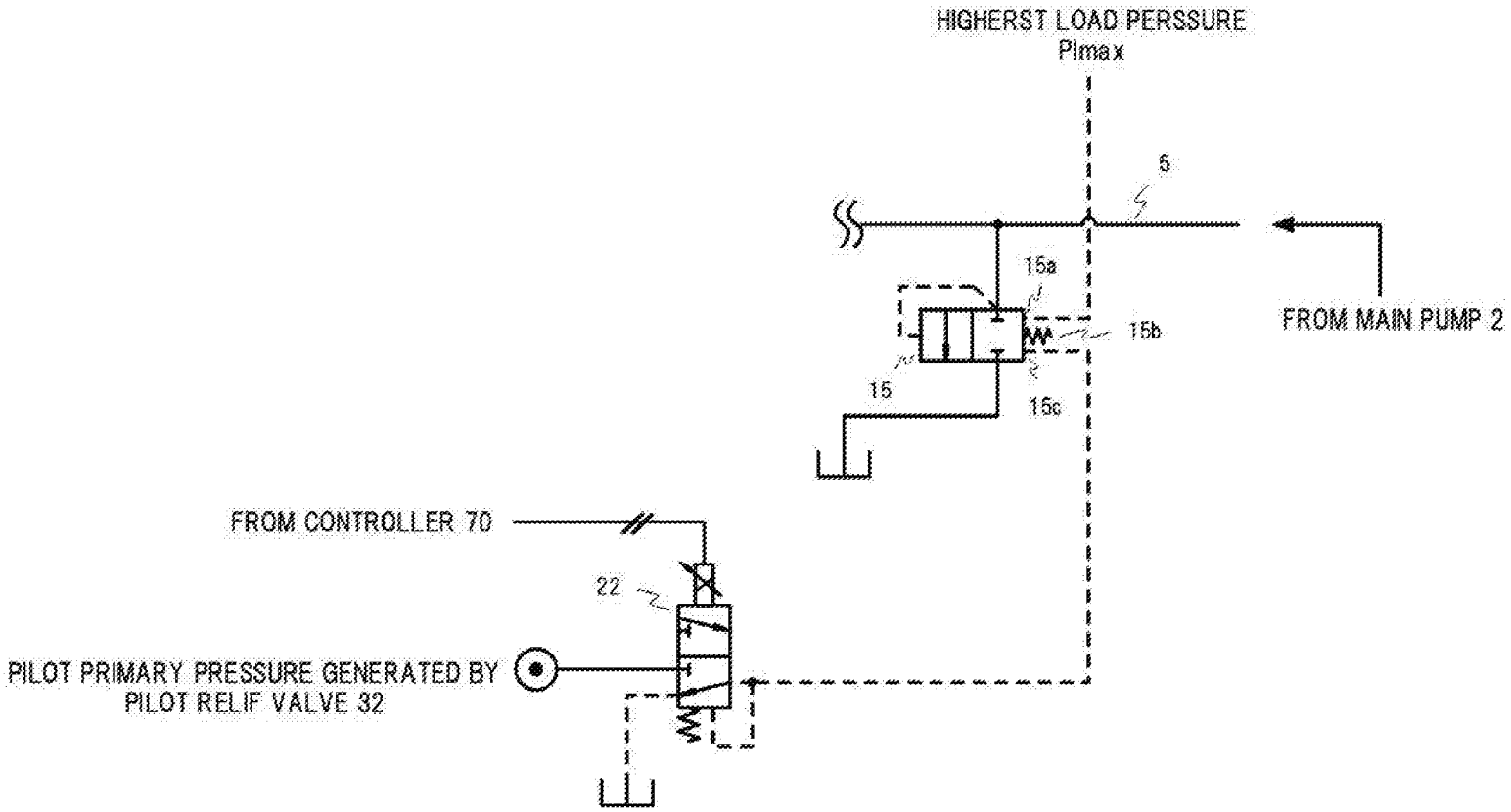
FIG. 2 is an enlarged view of peripheral elements of an unloading valve in the hydraulic drive system of the first embodiment.

FIG. 2 is an enlarged view of peripheral elements of the unloading valve. The unloading valve 15 includes a pressure receiving portion 15*a* to which the highest load pressure of the plurality of actuators 3*a*, 3*b*, 3*c*, . . . is introduced in a direction in which the unloading valve 15 is closed, and a spring 15*b*. Further, the unloading valve 15 further includes a solenoid proportional pressure reducing valve 22 for generating a control pressure for the unloading valve 15, and the unloading valve 15 has a pressure receiving portion 15*c* to which an output pressure or control pressure of the solenoid proportional pressure reducing valve 22 is introduced in a direction in which the unloading valve 15 is to be closed.

The hydraulic drive system of the present embodiment includes a regulator 11 for controlling the displacement of the main pump 2 and a solenoid proportional pressure reducing valve 21 for causing the regulator 11 to generate a command pressure.

Figure 3:
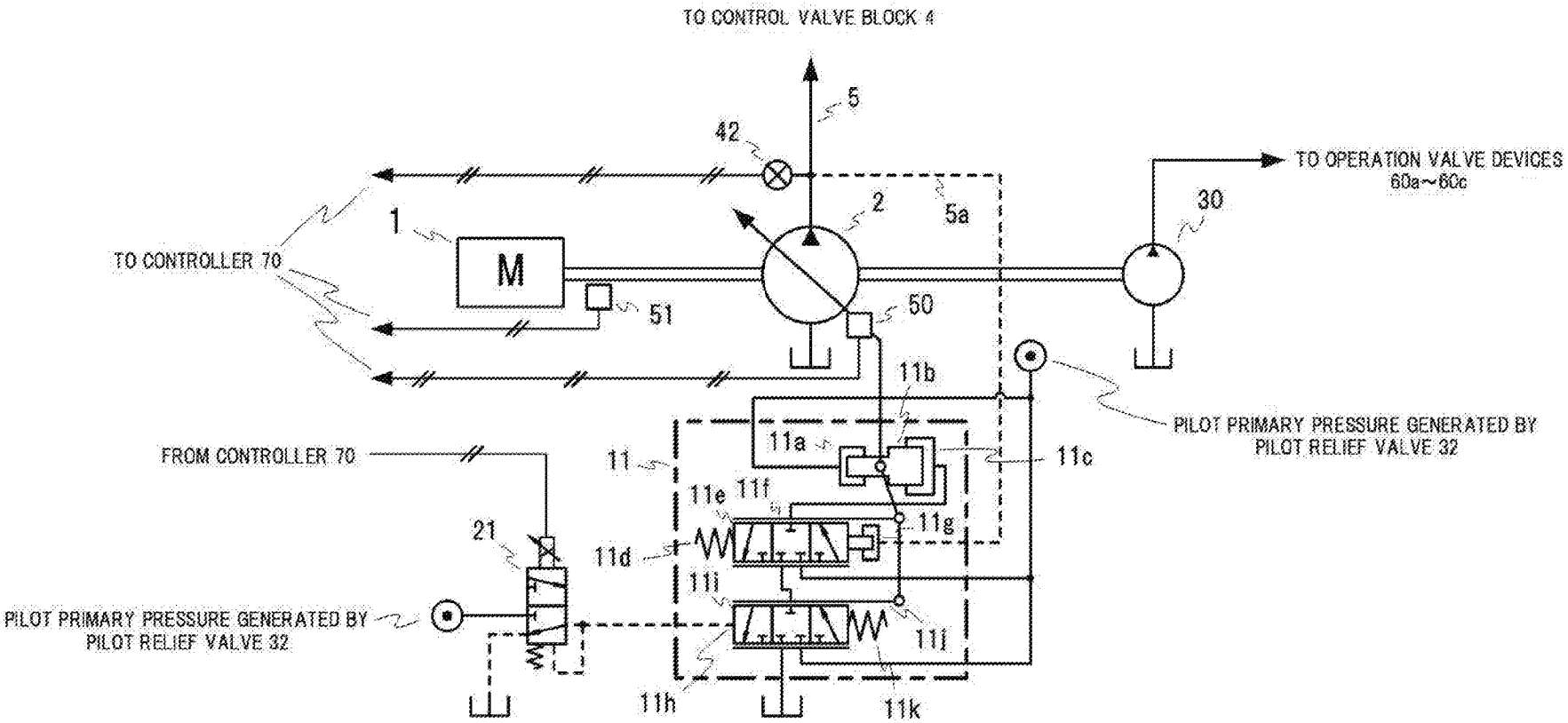
FIG. 3 is an enlarged view of peripheral elements of a main pump including a regulator in the hydraulic drive system of the first embodiment.

FIG. 3 is an enlarged view of peripheral elements of the main pump including the regulator 11. The regulator 11 includes a differential piston 11*b* that is driven by a pressure receiving area difference, a horsepower controlling tilting control valve 11*e* and a flow controlling tilting control valve 11*i*. A large diameter side pressure receiving chamber 11*c* of the differential piston 11*b* is connected to a line 31*a*, which is a pilot hydraulic fluid source and is a hydraulic fluid supply line to the pilot pump 30, or the flow controlling tilting control valve 11*i* through the horsepower controlling tilting control valve 11*e*. A small diameter side pressure receiving chamber 11*a* is normally connected to the line 31*a*, and the flow controlling tilting control valve 11*i* is configured so as to introduce the pressure of the line 31*a* or the tank pressure to the horsepower controlling tilting control valve 11*e*.

The horsepower controlling tilting control valve 11*e* includes a sleeve 11*f* that moves together with the differential piston 11*b*, a spring 11*d* and a pressure receiving chamber 11*g*. The spring 11*d* is positioned on the side on which the flow controlling tilting control valve 11*i* and the large diameter side pressure receiving chamber 11*c* of the differential piston 11*b* are communicated with each other. To the pressure receiving chamber 11*g*, the pressure of the hydraulic fluid supply line 5 of the main pump 2 is introduced through a line 5*a* in a direction in which the line 31*a* and the small and large diameter side pressure receiving chambers 11*a* and 11*c* of the differential piston 11*b* are communicated with each other.

The flow controlling tilting control valve 11*i* includes a sleeve 11*j* that moves together with the differential piston 11*b*, a pressure receiving portion 11*h* and a spring 11*k*. To the pressure receiving portion 11*h*, an output pressure or control pressure of the solenoid proportional pressure reducing valve 21 is introduced in a direction in which hydraulic fluid of the horsepower controlling tilting control valve 11*e* is discharged to the tank. The spring 11*k* is positioned on the side of the line 31*a* in which hydraulic fluid is introduced to the horsepower controlling tilting control valve 11*e*.

If the large diameter side pressure receiving chamber 11*c* is communicated with the line 31*a* through the horsepower controlling tilting control valve 11*e* and the flow controlling tilting control valve 11*i*, then the differential piston 11*b* is moved in a leftward direction in the figure by the pressure receiving area difference, but if the large diameter side pressure receiving chamber 11*c* is communicated with the tank through the horsepower controlling tilting control valve 11*e* and the flow controlling tilting control valve 11*i*, then the differential piston 11*b* is moved in the rightward direction in the figure by the force received from the small diameter side pressure receiving chamber 11*a*. If the differential piston 11*b* moves in the leftward direction in the figure, then the tilting angle of the main pump 2 of the variable displacement type, namely, the pump displacement, decreases to decrease the delivery flow rate of the main pump 2, but if the differential piston 11*b* moves in the rightward direction in the figure, then the tilting angle and the pump displacement of the main pump 2 increase to increase the delivery flow rate of the main pump 2.

A pilot relief valve 32 is connected to the hydraulic fluid supply line, namely, to the line 31*a*, of the pilot pump 30 such that a fixed pilot pressure Pi0 is generated in the line 31*a* by the pilot relief valve 32.

To the downstream of the pilot relief valve 32, pilot valves of a plurality of operation lever devices 60*a*, 60*b*, 60*c*, . . . for controlling the plurality of directional control valves 6*a*, 6*b*, 6*c*, . . . are connected through a selector valve 33. By operating the selector valve 33 by a gate lock lever 34 provided on a driver's seat 521 depicted in FIG. 4 of the construction machine such as a hydraulic excavator, it is switched whether the pilot pressure (Pi0) generated by the pilot relief valve 32 is to be supplied as a pilot primary pressure to the pilot valve of the plurality of operation lever devices 60*a*, 60*b*, 60*c*, . . . or hydraulic fluid of the pilot valve is to be discharged to the tank.

The hydraulic drive system of the present embodiment further includes a pressure sensor 40 for detecting the highest load pressure of the plurality of actuators 3*a*, 3*b*, 3*c*, . . . pressure sensors 41*a*1 and 41*a*2 for detecting operation pressures a1 and a2 of the pilot valves of the operation lever device 60*a* for the boom cylinder 3*a*, pressure sensors 41*b*1 and 41*b*2 for detecting operation pressures b1 and b2 of the pilot valves of the operation lever device 60*b* for the arm cylinder 3*b*, a pressure sensor 41*c* for detecting operation pressures c1 and c2 of the pilot valves of the operation lever device 60*c* for the swing motor 3*c*, a pressure sensor not depicted for detecting an operation pressure of a pilot valve of an operation lever device for a different actuator not depicted, a pressure sensor 42 for detecting the pressure of the hydraulic fluid supply line 5 of the main pump 2, namely, the delivery pressure of the main pump 2, a tilting angle sensor 50 for detecting the tilting angle of the main pump 2, a speed sensor 51 for detecting the revolution speed of the prime mover 1, and a controller 70.

The controller 70 is configured from a microcomputer, which includes a CPU, a storage section configured from a ROM (Read Only Memory), a RAM (Random Access Memory), or a flash memory and so forth, and peripheral circuits of the microcomputer not depicted. The controller 70 acts in accordance with a program stored, for example, in the ROM.

The controller 70 receives detection signals of the pressure sensor 40, pressure sensors 41*a*1, 41*a*2, 41*b*1, 41*b*2, 41*c*, . . . , pressure sensor 42, tilting angle sensor 50 and speed sensor 51 as input signals thereto and outputs control signals to the solenoid proportional pressure reducing valves 21 and 22.

Figure 4:
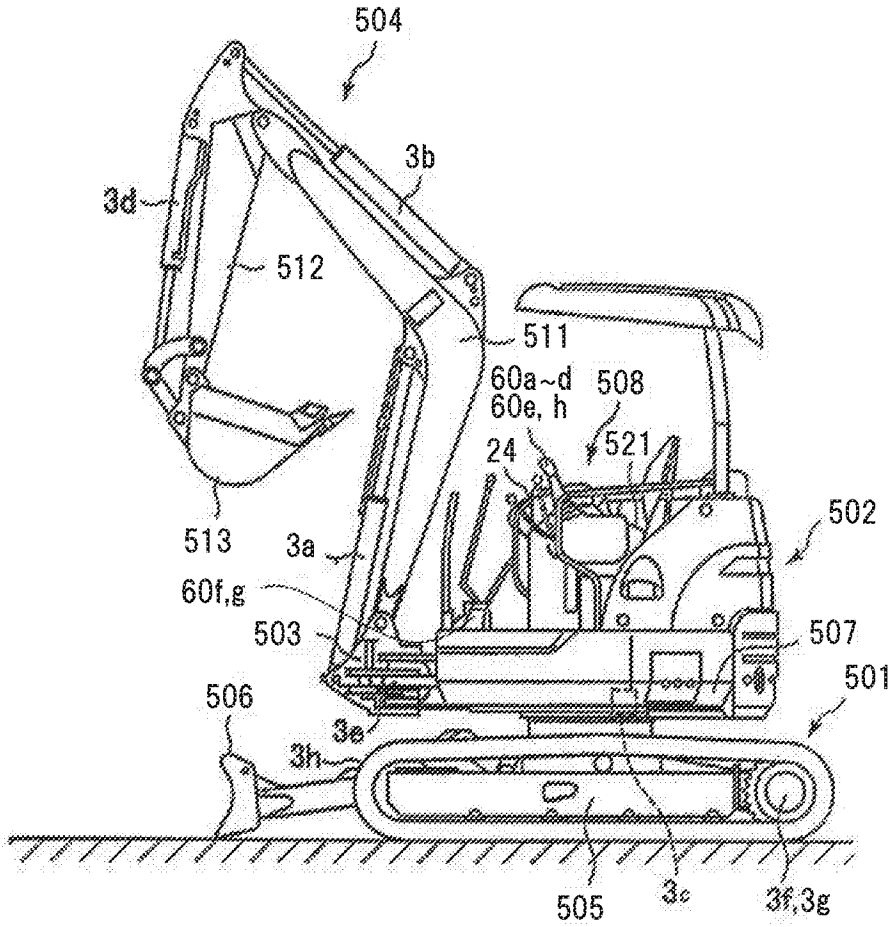
FIG. 4 is a view depicting an appearance of a hydraulic excavator that is a representative example of a construction machine in which the hydraulic drive system of the present invention is incorporated.

FIG. 4 depicts an appearance of a hydraulic excavator in which the hydraulic drive system described above is incorporated.

The hydraulic excavator includes an upper swing structure 502, a lower track structure 501, and a front work implement 504 of the swing type. The front work implement 504 is configured from a boom 511, an arm 512 and a bucket 513. The upper swing structure 502 is swingable with respect to the lower track structure 501 by rotation of the swing motor 3*c*. A swing post 503 is attached to a front portion of the upper swing structure, and the front work implement 504 is attached for upward and downward movement to the swing post 503. The swing post 503 is pivotally movable in a horizontal direction with respect to the upper swing structure 502 by expansion and contraction of the swing cylinder 3*e*, and the boom 511, arm 512 and bucket 513 of the front work implement 504 are pivotally movable in an upward and downward direction by expansion and contraction of the boom cylinder 3*a*, arm cylinder 3*b* and bucket cylinder 3*d*. To a middle frame 505 of the lower track structure 501, a blade 506 is attached which performs upward and downward actions by expansion and contraction of the blade cylinder 3*h*. The lower track structure 501 travels by rotation of the travelling motors 3*f* and 3*g* to drive left and right crawler belts.

An operation room 508 is provided on the upper swing structure 502, and in the operation room 508, the driver's seat 521, operation lever devices 60*a*, 60*b*, 60*c* and 60*d* for the boom cylinder 3*a*, arm cylinder 3*b*, bucket cylinder 3*d* and swing motor 3*c*, an operation lever device 60*e* for the swing cylinder 3*e*, an operation lever device 60*h* for the blade cylinder 3*h*, operation lever devices 60*f* and 60*g* for the travelling motors 3*f* and 3*g* and a gate lock lever 24 are provided at left and right front portions around the driver's seat 521.

Figure 5:
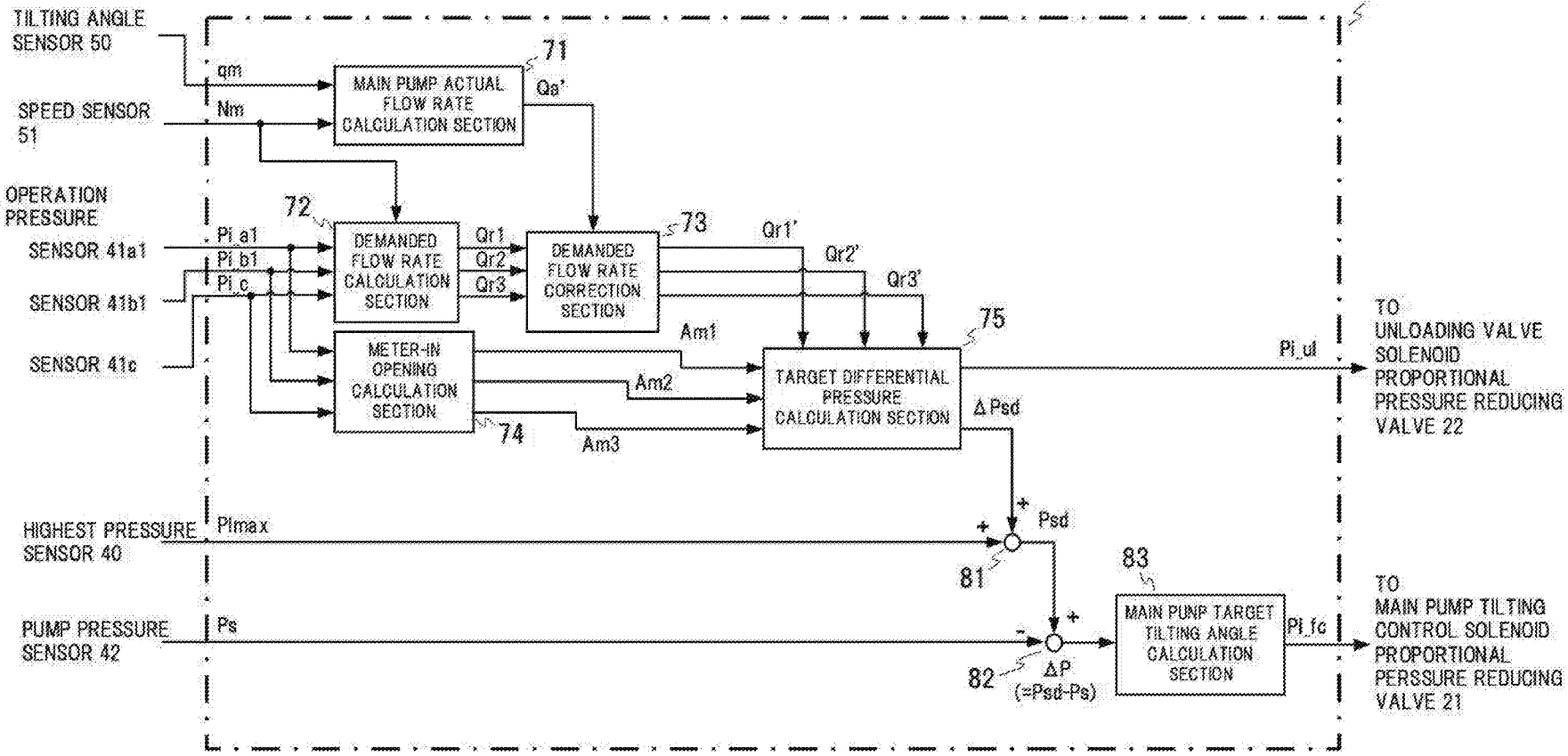
FIG. 5 is a functional block diagram of a controller in the hydraulic drive system of the first embodiment.

FIG. 5 depicts a functional block diagram of the controller 70 in the hydraulic drive system depicted in FIG. 1.

An output of the tilting angle sensor 50 indicative of the tilting angle of the main pump 2 and an output of the speed sensor 51 indicative of the revolution speed of the prime mover 1 are inputted to a main pump actual flow rate calculation section 71. An output of the speed sensor 51 and outputs of the pressure sensors 41*a*1, 41*b*1 and 41*c* indicative of lever operation amounts or operation pressures are inputted to a demanded flow rate calculation section 72. Further, outputs of the pressure sensors 41*a*1, 41*b*1 and 41*c* are inputted to a meter-in opening calculation section 74. It is to be noted that, in FIGS. 5 to 11 and the following description, " . . . " that suggests an element not depicted in FIG. 1 are sometimes omitted for simplification.

Further, an output Plmax of the pressure sensor 40 indicative of the highest load pressure of the plurality of actuators 3*a*, 3*b*, 3*c*, . . . is introduced to an adding section 81, and an output Ps of the pressure sensor 42 indicative of a delivery pressure or pump pressure of the main pump 2 is introduced to a differencing section 82.

Demanded flow rates Qr1, Qr2 and Qr3 that are outputs of the demanded flow rate calculation section 72 and a flow rate Qa' that is an output of the main pump actual flow rate calculation section 71 are sent to a demanded flow rate correction section 73.

Outputs Qr1', Qr2' and Qr3' of the demanded flow rate correction section 73 and outputs Am1, Am2 and Am3 of the meter-in opening calculation section 74 are sent to a target differential pressure calculation section 75.

The target differential pressure calculation section 75 outputs a command pressure or command value Pi_ul to the solenoid proportional pressure reducing valve 22 for the unloading valve and outputs a target differential pressure ΔPsd to the adding section 81.

The adding section 81 adds the target differential pressure ΔPsd and the highest load pressure Plmax to calculate a target pump pressure Psd=Plmax+ΔPsd and outputs the target pump pressure Psd to the differencing section 82.

The differencing section 82 subtracts the pump pressure or actual pump pressure Ps that is an output of the pressure sensor 42 from the target pump pressure Psd to calculate a differential pressure ΔP=Psd−Ps and outputs the differential pressure ΔP to a main pump target tilting angle calculation section 83.

The main pump target tilting angle calculation section 83 calculates a command pressure Pi_fc from the inputted differential pressure ΔP=Psd−Ps and outputs the command pressure Pi_fc as a command value to the solenoid proportional pressure reducing valve 21.

In the demanded flow rate calculation section 72, demanded flow rate correction section 73 and meter-in opening calculation section 74, and target differential pressure calculation section 75, the controller 70 calculates demanded flow rates for the plurality of actuators 3*a*, 3*b* and 3*c* and meter-in opening areas of the plurality of directional control valves 6*a*, 6*b* and 6*c* on the basis of input amounts of the operation levers of the plurality of operation lever devices 60*a*, 60*b* and 60*c*. Then, the controller 70 calculates the meter-in pressure loss of a particular directional control valve among the plurality of directional control valves 6*a*, 6*b* and 6*c* on the basis of the meter-in opening areas and the demanded flow rates and outputs the pressure loss as the target differential pressure ΔPsd to control the set pressure of the unloading valve 15.

Further, in the target differential pressure calculation section 75, the controller 70 selects a maximum value of the meter-in pressure loss of the plurality of directional control valves 6*a*, 6*b* and 6*c* as meter-in pressure loss of the particular directional control value, and outputs the pressure loss as the target differential pressure ΔPsd to control the set pressure of the unloading valve 15.

Furthermore, in the main pump target tilting angle calculation section 83, the controller 70 calculates a command value Pi_fc for making the delivery pressure of the main pump 2 (namely, hydraulic pump) detected by the pressure sensor 42 equal to a sum of the highest load pressure detected by the highest load pressure detection device (namely, the shuttle valves 9*a*, 9*b* and 9*c*) and the target differential pressure, and outputs the command value Pi_fc to the regulator 11 (namely, a pump regulation device) to control the delivery flow rate of the main pump 2.

Figure 6:
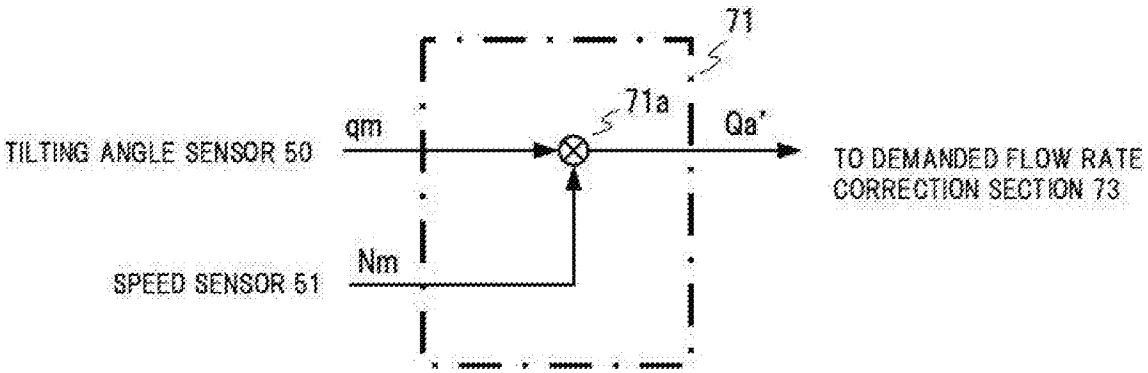
FIG. 6 is a functional block diagram of a main pump actual flow rate calculation section in the controller.

FIG. 6 depicts a functional block diagram of the main pump actual flow rate calculation section 71.

In the main pump actual flow rate calculation section 71, a tilting angle qm inputted from the tilting angle sensor 50 and a rotational speed Nm inputted from the speed sensor 51 are multiplied by a multiplier 71*a* to calculate a flow rate Qa' actually delivered from the main pump 2.

Figure 7:
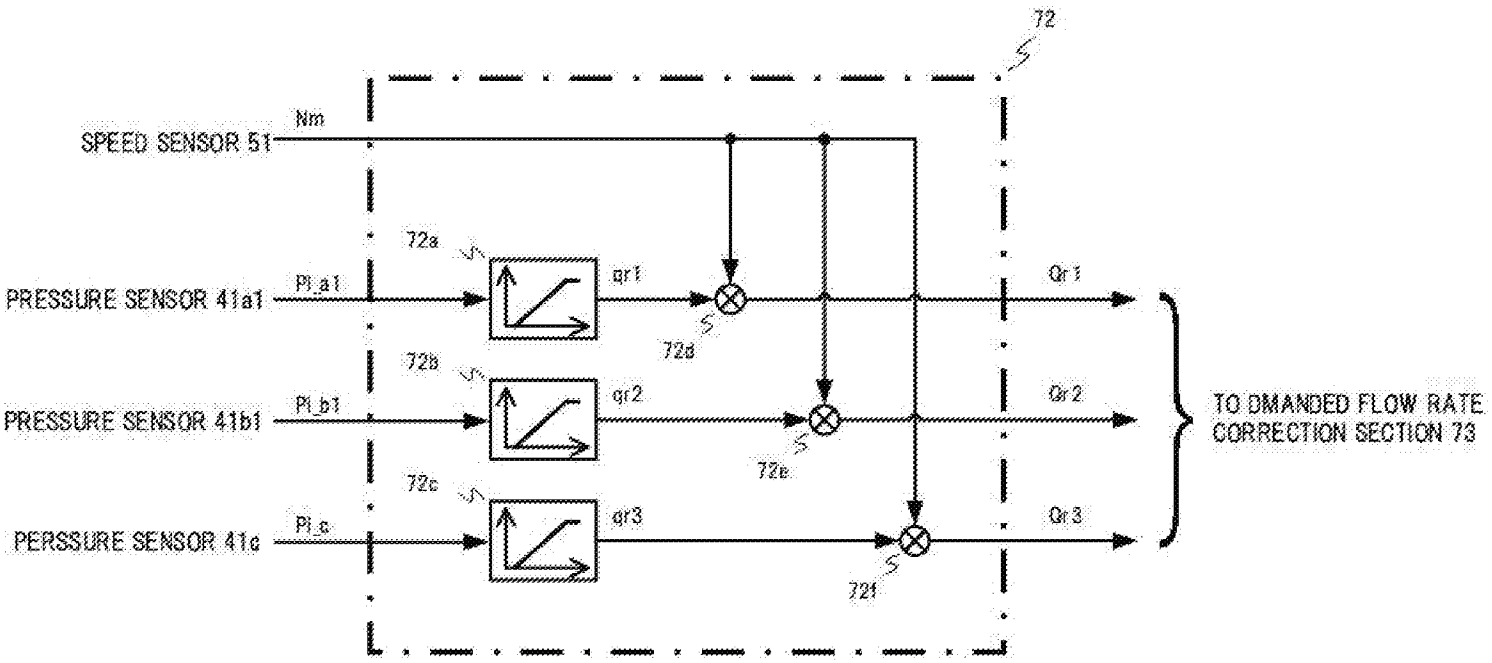
FIG. 7 is a functional block diagram of a demanded flow rate calculation section in the controller.

FIG. 7 depicts a functional block diagram of the demanded flow rate calculation section 72.

In the demanded flow rate calculation section 72, operation pressures Pi_a1, Pi_b1 and Pi_c inputted from the pressure sensors 41*a*1, 41*b*1 and 41*c* are converted into demanded flow rates qr1, qr2 and qr3 by tables 72*a*, 72*b* and 72*c*, respectively, and are multiplied by the rotational speed Nm inputted from the speed sensor 51 by multipliers 72*d*, 72*e* and 72*f* to calculate demanded flow rates Qr1, Qr2 and Qr3 for the plurality of actuators 3*a*, 3*b*, 3*c*, . . . , respectively.

Figure 8:
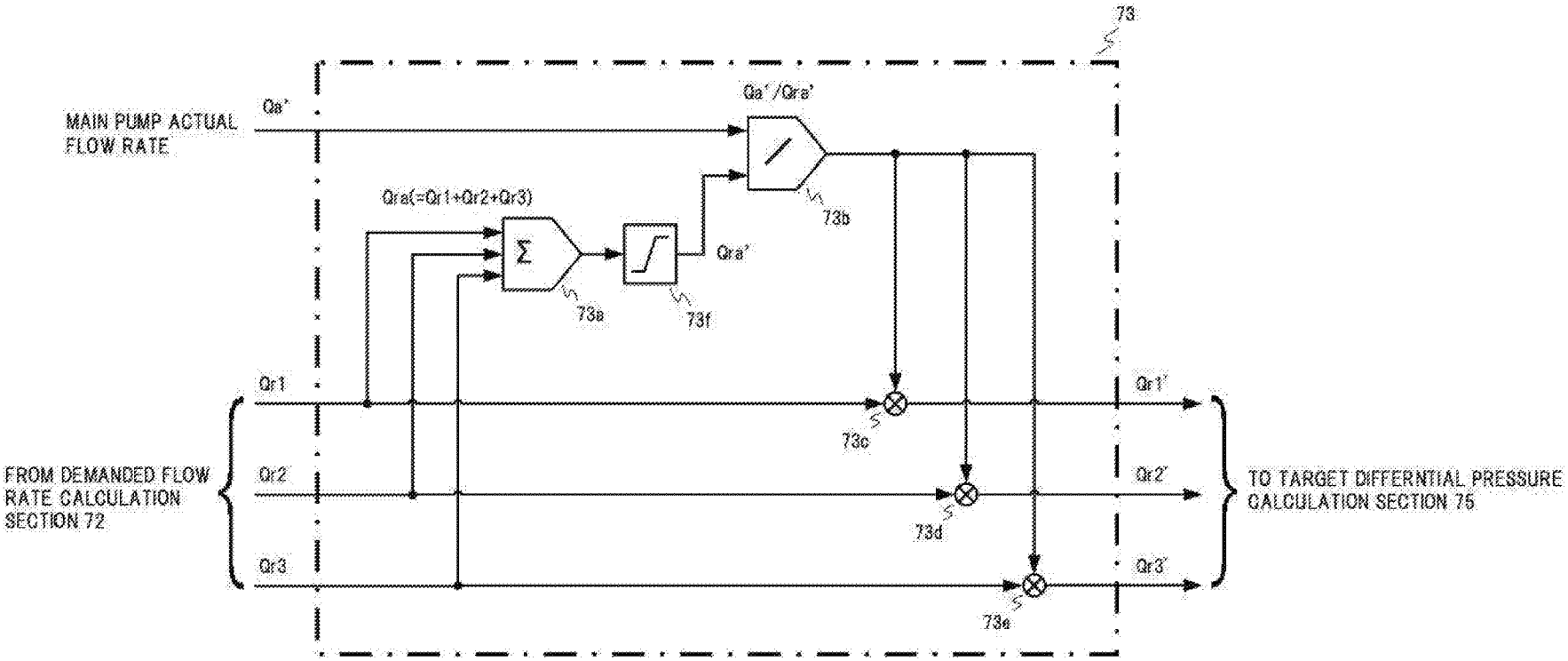
FIG. 8 is a functional block diagram of a demanded flow rate correction section in the controller.

FIG. 8 depicts a functional block diagram of the demanded flow rate correction section 73.

In the demanded flow rate correction section 73, the demanded flow rates Qr1, Qr2 and Qr3 outputted from the demanded flow rate calculation section 72 are inputted to multiplier sections 73*c*, 73*d* and 73*e* and a summing section 73*a*, and a total value Qra of them is calculated by the summing section 73*a*. The total value Qra is inputted to the denominator side of a subtractor section 73*b* through a limiting section 73*f* that limits the total value Qra between a minimum value and a maximum value. Meanwhile, the flow rate Qa' outputted from the main pump actual flow rate calculation section 71 is inputted to the numerator side of the subtractor section 73*b*, and the subtractor section 73*b* outputs the value of Qa'/Qra to the multiplier sections 73*c*, 73*d* and 73*e*. By the multiplier sections 73*c*, 73*d* and 73*e*, Qr1, Qr2 and Qr3 are multiplied by Qa'/Qra described above to calculate corrected demanded flow rates Qr1', Qr2' and Qr3'.

Figure 9:
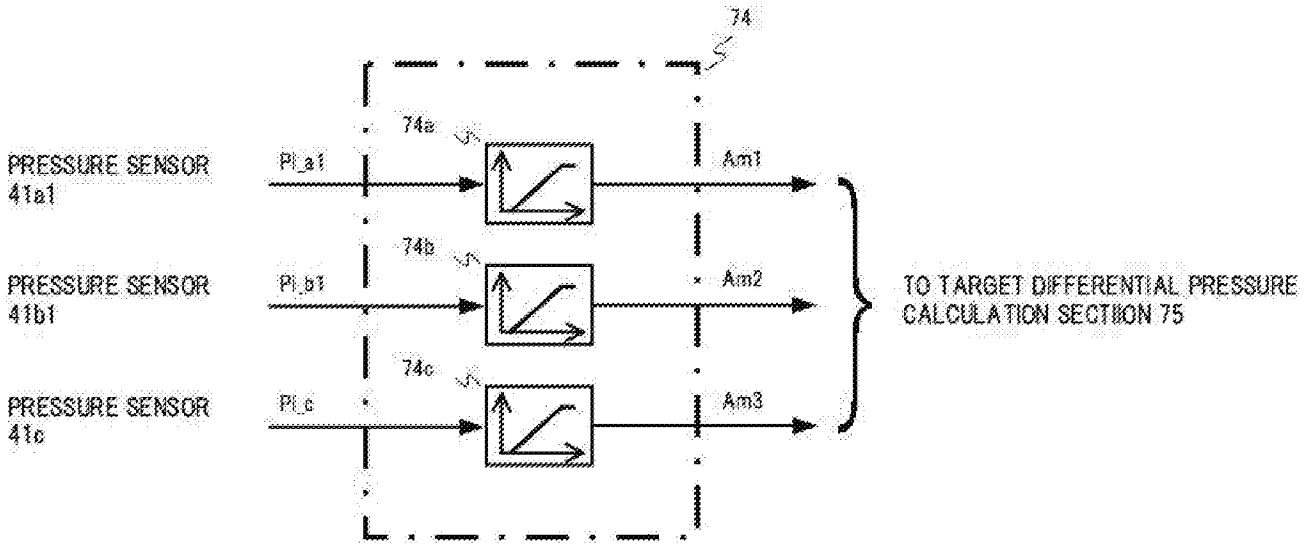
FIG. 9 is a functional block diagram of a meter-in opening calculation section in the controller.

FIG. 9 depicts a functional block diagram of the meter-in opening calculation section 74.

In the meter-in opening calculation section 74, the operation pressures Pi_a1, Pi_b1 and Pi_c inputted from the pressure sensors 41*a*1, 41*b*1 and 41*c* are converted into meter-in opening areas Am1, Am2 and Am3 of the directional control valves by tables 74*a*, 74*b* and 74*c*, respectively. The tables 74*a*, 74*b* and 74*c* have stored therein in advance meter-in opening areas of the directional control valves 6*a*, 6*b* and 6*c* and are set such that, when the operation pressure is zero, zero is outputted and, as the operation voltage increases, an increasing value is outputted. Further, the maximum value of the meter-in opening areas is set to an extremely high value such that the meter-in pressure loss or LS differential pressure that is a pressure loss that possibly occurs at the meter-in openings of the directional control valves 6*a*, 6*b* and 6*c* becomes extremely small.

Figure 10:
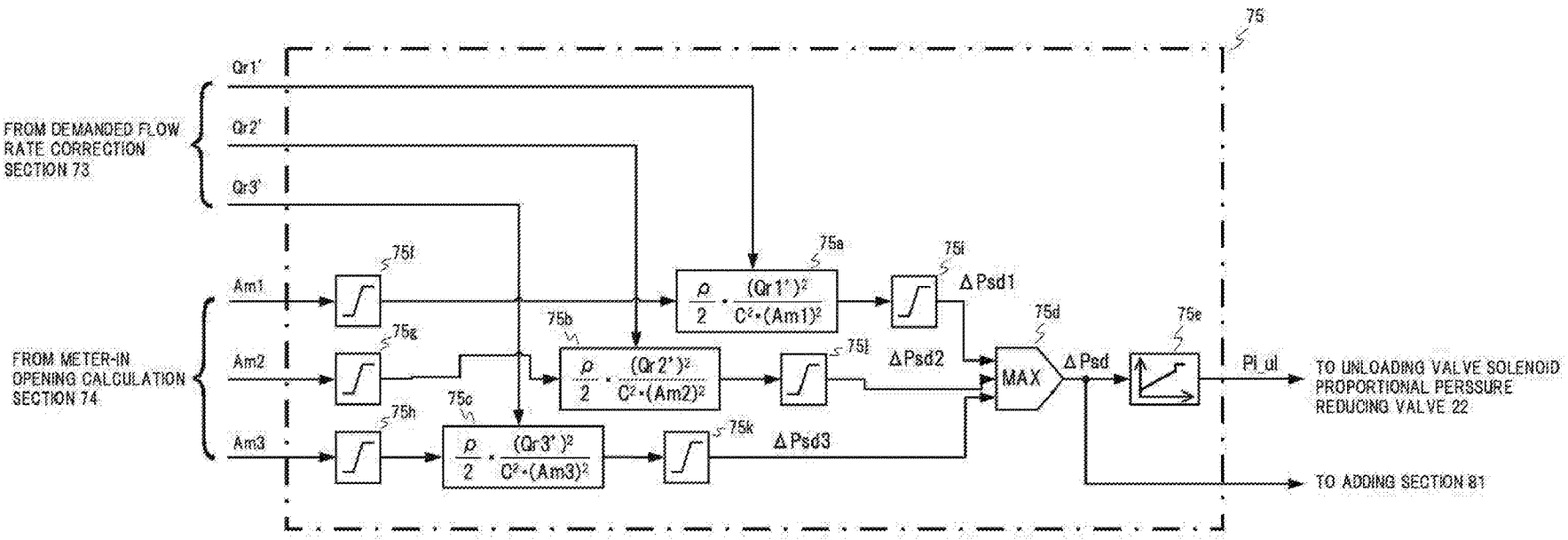
FIG. 10 is a functional block diagram of a target differential pressure calculation section in the controller.

FIG. 10 depicts a functional block diagram of the target differential pressure calculation section 75.

Inputs Qr1', Qr2' and Qr3' from the demanded flow rate correction section 73 are inputted to calculating sections 75*a*, 75*b* and 75*c*, respectively. Meanwhile, inputs Am1, Am2 and Am3 from the meter-in opening calculation section 74 are inputted to calculating sections 75*a*, 75*b* and 75*c* through limiting sections 75*f*, 75*g* and 75*h*, which limit the inputs between a minimum value and a maximum value. The calculating sections 75*a*, 75*b* and 75*c* use the inputs Qr1', Qr2' and Qr3' and Am1, Am2 and Am3 to calculate meter-in pressure losses ΔPsd1, ΔPsd2 and ΔPsd3 of the directional control valves 6*a*, 6*b* and 6*c* by expressions given below. Here, C is a contraction coefficient determined in advance, and ρ is a density of hydraulic fluid.

[Math. 1]

$$\Delta Psd1 = \frac{\rho}{2} \cdot \frac{(Qr1')^2}{C^2 \cdot (Am1)^2}$$

$$\Delta Psd2 = \frac{\rho}{2} \cdot \frac{(Qr2')^2}{C^2 \cdot (Am2)^2}$$

$$\Delta Psd3 = \frac{\rho}{2} \cdot \frac{(Qr3')^2}{C^2 \cdot (Am3)^2}$$

The pressure losses ΔPsd1, ΔPsd2 and ΔPsd3 are inputted to a maximum value selecting section 75*d* through limiting sections 75*i*, 75*j* and 75*k* that limit an input thereto between a minimum value and a maximum value. The maximum value selecting section 75*d* outputs a maximum one of the pressure losses ΔPsd1, ΔPsd2 and ΔPsd3 as a target differential pressure ΔPsd, which is an adjustment pressure for variably controlling the set pressure of the unloading valve 15, to the adding section 81. Further, the target differential pressure ΔPsd is converted into a command pressure Pi_ul by a table 75*e* and outputted as a command value to the solenoid proportional pressure reducing valve 22.

Figure 11:
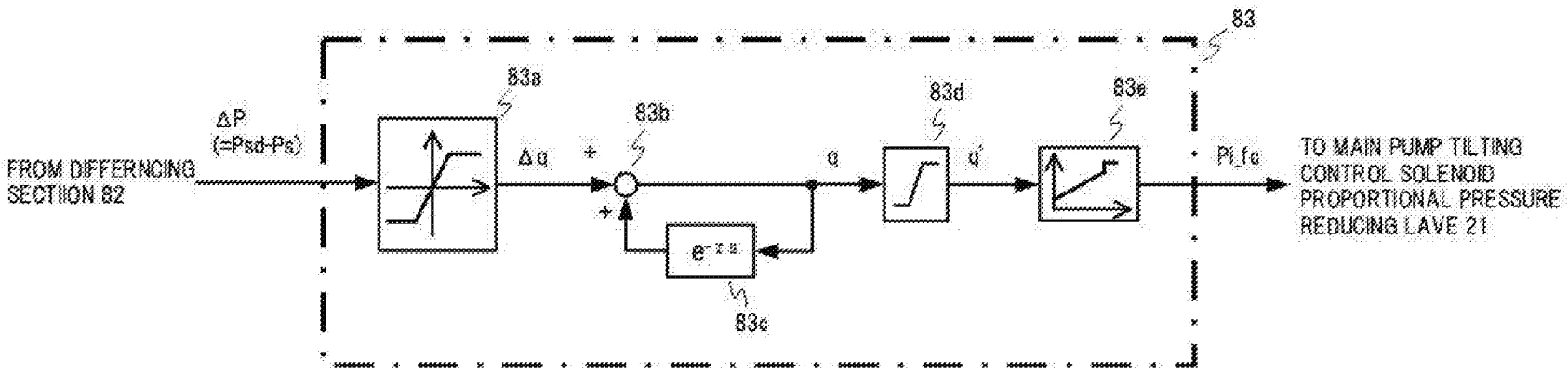
FIG. 11 is a functional block diagram of a main pump target tilting angle calculation section in the controller.

FIG. 11 depicts a functional block diagram of the main pump target tilting angle calculation section 83.

In the main pump target tilting angle calculation section 83, the differential pressure ΔP=Psd−Ps calculated by the differencing section 82 is inputted to a table 83*a*, by which it is converted into a target displacement change amount Δq. Δq is added by an adding section 83*b* to a target displacement q' one control cycle before outputted from a delay element 83*c* and is outputted as a new target displacement q to a limiting section 83*d*. By the limiting section 83*d*, the target displacement q is limited to value between a minimum value and a maximum value therefor and is sent as a limited target displacement q' to a table 83*e*. The target displacement q' is converted into a command pressure Pi_fc to the solenoid proportional pressure reducing valve 21 by the table 83*e* and outputted as a command value.

~Action~

Action of the hydraulic drive system configured in such a manner as described above is described.

Hydraulic fluid delivered from the pilot pump 30 of the fixed displacement type is supplied to the hydraulic fluid supply line 31*a*, and a fixed pilot primary pressure Pi0 is generated in the hydraulic fluid supply line 31*a* by the pilot relief valve 32.

(a) Where all Operation Levers are Neutral

Since the operation levers for all operation lever devices 60*a*, 60*b*, 60*c*, . . . are neutral, all pilot valves are neutral, and the operation pressures a1, a2, b1, b2, c1, c2, . . . are equal to the tank pressure. Therefore, all directional control valves 6*a*, 6*b*, 6*c*, . . . are at their neutral position.

Since all directional control valves 6*a*, 6*b* and 6*c* are at the neutral position, the load pressure detection lines of the actuators are connected to the tank through the directional control values associated with the individual actuators.

Therefore, the tank pressure is detected as the highest load pressure Plmax through the shuttle valves 9*a*, 9*b* and 9*c* that are the highest load pressure detection device, and this highest load pressure Plmax is introduced to the pressure receiving portion 15*a* of the unloading valve 15 and the pressure sensor 40.

The boom raising operation pressure a1, arm crowding operation pressure b1 and swinging operation pressure c are detected by the pressure sensors 41*a*1, 41*b*1 and 41*c*, respectively, and outputs Pi_a1, Pi_b1 and Pi_c of the pressure sensors are sent to the demanded flow rate calculation section 72 and the meter-in opening calculation section 74.

The tables 72*a*, 72*b* and 72*c* of the demanded flow rate calculation section 72 have stored in advance therein reference demanded flow rates for each lever input for boom raising, arm crowding and swinging action, respectively, and are set such that, when the input is zero, zero is outputted, and as the input increases, an increasing value is outputted.

As described hereinabove, in the case where all operation levers are neutral, since the operation pressures Pi_a1, Pi_b1 and Pi_c are equal to the total tank pressure, all of the reference demanded flow rates qr1, qr2 and qr3 calculated by the tables 72*a*, 72*b* and 72*c* are zero. Since all of qr1, qr2 and qr3 are zero, demanded flow rates Qr1, Qr2 and Qr3 outputted from the multipliers 72*d*, 72*e* and 72*f* are zero.

Further, the tables 74*a*, 74*b* and 74*c* of the meter-in opening calculation section 74 have stored therein in advance meter-in opening areas of the directional control valves 6*a*, 6*b* and 6*c*, respectively, and are configured such that, when the input is zero, zero is outputted, and as the input increases, an increasing value is outputted.

As described hereinabove, in the case where all of the operation levers are neutral, since the operation pressures Pi_a1, Pi_b1 and Pi_c are equal to the total tank pressure, the meter-in opening areas Am1, Am2 and Am3 that are outputs of the tables 74*a*, 74*b* and 74*c* are zero.

The demanded flow rates Qr1, Qr2 and Qr3 are inputted to the demanded flow rate correction section 73.

The demanded flow rates Qr1, Qr2 and Qr3 inputted to the demanded flow rate correction section 73 are sent to the summing section 73*a* and the multiplier sections 73*c*, 73*d* and 73*e*.

The summing section 73*a* calculates Qra=Qr1+Qr2+Qr3, and in the case where all operation levers are neutral as described above, Qra=0+0+0.

The limiting section 73*f* performs limitation between a minimum value and a maximum value between which hydraulic fluid can be delivered from the main pump 2. Here, if the minimum value is represented by Qmin and the maximum value is represented by Qmax, then in the case where all operation levers are neutral, Qra=0<Qmin, and therefore, Qra is limited to Qmin by the limiting section 73*f* and Qra'=Qmin is sent to the denominator side of the subtractor section 73*b*.

On the other hand, as hereinafter described, in the case where all operation levers are neutral, since the main pump actual flow rate is kept to the minimum value Qmin, the subtractor section 73*b* outputs Qr'/Qr'=1 to the multiplier sections 73*c*, 73*d* and 73*e*.

As described hereinabove, in the case where all operation levers are neutral, since all of Qr1, Qr2 and Qr3 are zero, all of the outputs Qr1', Qr2' and Qr3' of the multiplier sections 73*c*, 73*d* and 73*e* are 0×1=0.

The target differential pressure calculation section 75 calculates the pressure loss occurring at the meter-in opening of the directional control valves 6*a*, 6*b* and 6*c* from corrected demanded flow rates Qr1', Qr2' and Qr3' and the meter-in opening areas Am1, Am2 and Am3 in accordance with the expressions given hereinabove.

First, the meter-in opening areas Am1, Am2 and Am3 are limited to minimum values Am1', Am2' and Am3', which are determined in advance and are higher than zero, by the limiting sections 75*f*, 75*g* and 75*h*, respectively.

Although, in the case where all operation levers are neutral, all of the meter-in opening areas Am1, Am2 and Am3 and the corrected demanded flow rates Qr1', Qr2' and Qr3' are zero as described hereinabove, since the meter-in opening areas Am1, Am2 and Am3 are limited to a certain value higher than zero as described hereinabove, the pressure losses ΔPsd1, ΔPsd2 and ΔPsd3 that are outputs of the calculating sections 75*a*, 75*b* and 75*c* are zero. The pressure losses ΔPsd1, ΔPsd2 and ΔPsd3 that are outputs of the calculating sections 75*a*, 75*b* and 75*c* are limited to a value equal to or higher than zero but equal to or lower than a maximum value ΔPsc_max determined in advance by the limiting sections 75*i*, 75*j* and 75*k*, respectively, and a maximum value of the pressure losses ΔPsd1, ΔPsd2 and ΔPsd3 is outputted as a target differential pressure ΔPsd from the maximum value selecting section 75*d*.

As described above, in the case where all operation levers are neutral, the target differential pressure ΔPsd is zero.

The target differential pressure ΔPsd is converted into a command value Pi_ul by the table 75*e* and is outputted as a command value to the solenoid proportional pressure reducing valve 22 for the unloading valve.

As described above, in the case where all operation levers are neutral, the highest load pressure Plmax is equal to the tank pressure.

Although the set pressure of the unloading valve 15 depends upon the highest load pressure Plmax introduced to the pressure receiving portion 15*a*, spring 15*b* and output pressure=ΔPsd of the solenoid proportional pressure reducing valve 22 introduced to the pressure receiving portion 15*c*, since both the highest load pressure Plmax and the output pressure=ΔPsd of the solenoid proportional pressure reducing valve 22 are equal to the tank pressure, the set pressure of the unloading valve 15 is kept to a very low value determined by the spring 15*b*.

Therefore, hydraulic fluid delivered from the main pump 2 of the variable displacement type is discharged from the unloading valve 15 to the tank, and the pressure of the hydraulic fluid supply line 5 is kept to the low pressure described above.

On the other hand, although the target differential pressure ΔPsd that is an output of the target differential pressure calculation section 75 is added to the highest load pressure Plmax by the adding section 81, since, in the case where all operation levers are neutral as described above, the target differential pressure ΔPsd is Plmax and ΔPsd is equal to the tank pressure zero, also the target pump pressure Psd that is an output of the target differential pressure calculation section 75 is zero.

The target pump pressure Psd and the pump pressure Ps detected by the pressure sensor 42 are sent to the positive side and the negative side of the differencing section 82 and are inputted as the difference ΔP=Psd−Ps between them to the main pump target tilting angle calculation section 83.

In the main pump target tilting angle calculation section 83, ΔP=Psd−Ps described above is converted into a target displacement change amount Δq by the table 83*a*. As depicted in FIG. 11, the table 83*a* is configured such that, when ΔP<0, Δq becomes Δq<0, when ΔP=0, Δq becomes Δq=0, and when ΔP>0, Δq becomes Δq>0, and, in the case where ΔP is greater or smaller by a certain amount or more, Δq is limited to a value determined in advance.

The target displacement change amount Δq becomes q by addition thereof to a target displacement q' one control step before hereinafter described by the adding section 83*b* and is limited to a value between physical minimum and maximum values of the main pump 2 by the limiting section 83*d* and then outputted as a target displacement q'.

The target displacement q' is converted into a command pressure Pi_fc to the solenoid proportional pressure reducing valve 21 by the table 83*e* to control the solenoid proportional pressure reducing valve 21.

As described hereinabove, in the case where all operation levers are neutral, Psd=highest load pressure Plmax+target differential pressure ΔPsd is equal to the tank pressure.

On the other hand, the pressure of the hydraulic fluid supply line 5, namely, the pump pressure Ps, is kept to a pressure higher by an amount defined by the spring 15*b* than the tank pressure by the unloading valve 15 as described hereinabove.

Therefore, in the case where all operation levers are neutral, since ΔP=Psd−Ps<0 is satisfied, ΔP becomes ΔP<0 by the table 83*a*. Although ΔP is added as new q to the adding section 83*b* and the target displacement q' one step before obtained by the delay element 83*c*, since it is limited by minimum and maximum tilting the main pump 2 has by the limiting section 83*d*, the target displacement q' one step before is kept to the minimum value.

(b) Where a Boom Raising Operation is Performed

A boom raising operation pressure a1 is outputted from the pilot valve of the operation lever device 60*a* for the boom. The boom raising operation pressure a1 is introduced to the directional control valve 6*a* and the pressure sensor 41*a*1, and the directional control valve 6*a* is shifted to the rightward direction in the figure.

Since the directional control valve 6*a* is shifted, the load pressure of the boom cylinder 3*a* is introduced as the highest load pressure Plmax to the unloading valve 15 and the pressure sensor 40 through the shuttle valve 9*a*.

Hydraulic fluid introduced from the hydraulic fluid supply line 5 to the directional control valve 6*a* is introduced to the upstream side of the pressure compensating valve 7*a* through the meter-in opening of the directional control valve 6*a*.

Although the pressure compensating valve 7*a* controls the pressure in the downstream side of the meter-in opening so as to become equal to the highest load pressure Plmax, in the case where boom raising is operated singly, since the highest load pressure Plmax is the load pressure of the boom cylinder 3*a*, the pressure compensating valve 7*a* is not throttled and the opening thereof is kept fully open.

The hydraulic fluid having passed the pressure compensating valve 7*a* is supplied to the bottom side of the boom cylinder 3*a* through the directional control valve 6*a* again. Since the hydraulic fluid is supplied to the bottom side of the boom cylinder 3*a*, the boom cylinder is expanded.

On the other hand, the boom raising operation pressure a1 is inputted as an output Pi_a1 of the pressure sensor 41*a*1 to the demanded flow rate calculation section 72, by which a demanded flow rate Qr1 is calculated.

Although, in response to inputs from the tilting angle sensor 50 and the speed sensor 51, the main pump actual flow rate calculation section 71 calculates a flow rate that is being delivered actually from the main pump 2, since, immediately after a boom raising operation is performed from the state in which all operation levers are neutral, the tilting of the variable displacement main pump 2 is kept to its minimum as described hereinabove in (a) the case in which all operation levers are neutral, also the pump actual flow rate Qa' has the minimum value.

The demanded flow rate Qr1 is limited to the main pump actual flow rate Qa' by the demanded flow rate correction section 73 and is corrected to Qr1'.

Meanwhile, the boom raising operation pressure a1 is sent as an output Pi_a1 of the pressure sensor 41*a*1 also to the meter-in opening calculation section 74, and it is converted into a meter-in opening area Am1 by the table 74*a* and outputted.

The target differential pressure calculation section 75 calculates a pressure loss, which occurs at the meter-in opening of each directional control valve, in accordance with the expressions given hereinabove from corrected demanded flow rates Qr1', Qr2' and Qr3' and the meter-in opening areas Am1, Am2 and Am3.

In the case where a boom raising operation is performed, the corrected demanded flow rate Qr1' and the meter-in opening area Am1 for boom operation are inputted to the calculating section 75*a*, by which the meter-in pressure loss ΔPsd1 of the directional control valve 6*a* is calculated in accordance with the following expression.

[Math. 2]

$$\Delta Psd1 = \frac{\rho}{2} \cdot \frac{(Qr1')^2}{C^2 \cdot (Am1)^2}$$

Although the meter-in pressure losses ΔPsd2 and ΔPsd3 of the directional control valves 6*b* and 6*c* are calculated similarly, since ΔPsd2=ΔPsd3=0 is satisfied similarly as in the case where all levers are neutral, the pressure loss ΔPsd1 that is the maximum value is selected by the maximum value selecting section 75*d*, and ΔPsd=ΔPsd1 is established. The pressure loss ΔPsd1 is converted into a command pressure Pi_ul to the solenoid proportional pressure reducing valve 22 for the unloading valve by and outputted from the table 75*e*, and the target differential pressure ΔPsd is outputted to the adding section 81 simultaneously.

The output ΔPsd of the solenoid proportional pressure reducing valve 22 for the unloading valve is introduced to the pressure receiving portion 15*c* of the unloading valve 15 and acts to raise the set pressure of the unloading valve 15 by an amount corresponding to ΔPsd.

Since the load pressure Pl1 of the boom cylinder 3*a* is introduced as Plmax to the pressure receiving portion 15*a* of the unloading valve 15 as described above, the set pressure of the unloading valve 15 is set to Plmax+ΔPsd+spring force, namely, Pl1 (load pressure of the boom cylinder 3*a*)+ΔPsd (differential pressure generated at the meter-in opening of the directional control valve 6*a* for controlling the boom cylinder 3*a*)+spring force, and the hydraulic fluid supply line 5 interrupts the line for discharging to the tank.

On the other hand, although the adding section 81 adds the highest load pressure Plmax and the target differential pressure ΔPsd described above to calculate the target pump pressure Psd=Plmax+ΔPsd, in the case where a boom raising single operation is performed, since Plmax=Pl1, the target pump pressure Psd=pl1 (load pressure of the boom cylinder 3*a*)+ΔPsd (differential pressure generated at the meter-in opening of the directional control valve 6*a* for controlling the boom cylinder 3*a*) is calculated and outputted to the differencing section 82.

The differencing section 82 calculates the difference between the target pump pressure Psd described above and the pressure of the hydraulic fluid supply line 5, namely, the actual pump pressure Ps, detected by the pressure sensor 42 as ΔP=Psd−Ps and outputs the difference ΔP to the main pump target tilting angle calculation section 83.

In the main pump target tilting angle calculation section 83, the differential pressure ΔP is converted into the target displacement change amount Δq by the table 83*a*. However, in the case where a boom raising operation is performed from the state in which all levers are neutral, at the beginning of the action, the actual pump pressure Ps is kept to a value lower than the target pump pressure Psd, which is described in (a) Where all operation levers are neutral. Therefore, ΔP=Psd−Ps has a positive value.

Since the table 83*a* is configured so as to have a characteristic that, in the case where the differential pressure ΔP has a positive value, also the target displacement change amount Δq has a positive value, also the target displacement change amount Δq has a positive value.

Although the target displacement change amount Δq described above is added to the target displacement q' one control step before to calculate new q by the adding section 83*b* and the delay element 83*c*, since the target displacement change amount Δq is in the positive as described above, the target displacement q' increases.

Further, the target displacement q' is converted into a command pressure Pi_fc to the solenoid proportional pressure reducing valve 21 for main pump tilting controlling by the table 83*e*, and the output=Pi_fc of the solenoid proportional pressure reducing valve 21 is introduced to the pressure receiving portion 11*h* of the flow controlling tilting control valve 11*i* in the regulator 11 of the main pump 2 such that the tilting angle of the main pump 2 is controlled so as to become equal to the target displacement q'.

Increase of the target displacement q' and the delivery amount of the main pump 2 continues until after the actual pump pressure Ps becomes equal to the target pump pressure Psd, and finally, the actual pump pressure Ps is kept in a situation in which it is equal to the target pump pressure Psd.

In this manner, since the main pump 2 determines a pressure obtained by adding the pressure loss ΔPsd, which may possibly occur at the meter-in opening of the directional control valve 6*a* associated with the boom cylinder 3*a*, to the highest load pressure Plmax as a target pressure and increases or decreases the flow rate, load sensing control in which the target differential pressure is variable is performed.

(c) Where a Boom Raising Operation and an Arm Crowding Operation are Performed Simultaneously A boom raising operation pressure a1 is outputted from the pilot valve of the operation lever device 60*a* for the boom and an arm crowding operation pressure b1 is outputted from the pilot valve of the operation lever device 60*b*.

The boom raising operation pressure a1 is introduced to the directional control valve 6*a* and the pressure sensor 41*a*1, and the directional control valve 6*a* is shifted to the rightward direction in the figure.

The arm crowding operation pressure b1 is introduced to the directional control valve 6*b* and the pressure sensor 41*b*1, and the directional control valve 6*b* is shifted to the rightward direction in the figure.

Since the directional control valves 6*a* and 6*b* are shifted, the load pressure of the boom cylinder 3*a* is introduced to the shuttle valve 9*a* through the directional control valve 6*a* and the load pressure of the arm cylinder 3*b* is introduced to the shuttle valve 9*a* through the directional control valve 6*b* and the shuttle valve 9*b*.

The shuttle valve 9*a* selects a higher one of the load pressure of the boom cylinder 3*a* and the load pressure of the arm cylinder 3*b* as the highest load pressure Plmax. In the case where action in the air is assumed, since normally the condition of the load pressure of the boom cylinder 3*a*>load pressure of the arm cylinder 3*b* is satisfied rather frequently, if the case of the load pressure of the boom cylinder 3*a*>load pressure of the arm cylinder 3*b* is considered, then the highest load pressure Plmax is equal to the load pressure of the boom cylinder 3*a*.

The highest load pressure Plmax is introduced to the pressure receiving portion 15*a* of the unloading valve 15 and the pressure sensor 40.

The pressure compensating valve 7*a* associated with the boom cylinder 3*a* controls the pressure in the downstream side of the meter-in opening of the directional control valve 6*a* associated with the boom cylinder 3*a* so as to be equal to the highest load pressure Plmax. However, in the case where the load pressure of the boom cylinder 3*a*>load pressure of the arm cylinder 3*b* is satisfied, since the highest load pressure Plmax=the load pressure of the boom cylinder 3*a*, the pressure compensating valve 7*a* is not throttled and the opening thereof is kept fully open.

Further, the pressure compensating valve 7*b* associated with the arm cylinder 3*b* controls the pressure in the downstream side of the meter-in opening of the directional control valve 6*b* associated with the arm cylinder 3*b* so as to become equal to the highest load pressure Plmax, namely, in this case, equal to the load pressure of the boom cylinder 3*a*. Consequently, the pressure in the downstream side of the meter-in opening of the directional control valve 6*b* is kept to Plmax=load pressure of the boom cylinder 3*a*.

Since the differential pressures across the directional control valves 6*a* and 6*b*, namely, the pump pressures that are common and the downstream side pressures of the meter-in openings are kept equal to each other, the directional control valves 6*a* and 6*b* distribute hydraulic fluid of the hydraulic fluid supply line 5 in response to the magnitude of the meter-in openings without depending upon the magnitude of the load pressures of the boom cylinder 3*a* and the arm cylinder 3*b*.

The hydraulic fluid having passed the pressure compensating valves 7*a* and 7*b* is supplied to the bottom side of the boom cylinder 3*a* and the bottom side of the arm cylinder 3*b* through the directional control valves 6*a* and 6*b* again, respectively.

Since hydraulic fluid is supplied to the bottom side of the boom cylinder 3*a* and the bottom side of the arm cylinder 3*b*, the boom cylinder and the arm cylinder are extended.

On the other hand, the boom raising operation pressure a1 and the arm crowding operation pressure b1 are inputted as outputs Pi_a1 and Pi_b1 of the pressure sensors 41*a*1 and 41*b*1 to the demanded flow rate calculation section 72, by which demanded flow rates Qr1 and Qr2 are calculated, respectively.

Although the main pump actual flow rate calculation section 71 calculates the flow rate actually delivered from the main pump 2 in response to inputs from the tilting angle sensor 50 and the speed sensor 51, immediately after boom raising and arm crowding operations are performed from the state in which all operation levers are neutral, the tilting of the variable displacement main pump 2 is kept to its minimum as described hereinabove in connection with the case (a) Where all operation levers are neutral. Therefore, also the flow rate Qa' is kept to the lowest value.

In the demanded flow rate correction section 73, the boom raising demanded flow rate Qr1 and the arm crowding demanded flow rate Qr2 are sent to the summing section 73*a*, by which Qra=Qr1+Qr2+Qr3=Qr1+Qr2 is calculated.

Qra calculated by the summing section 73*a* is limited to a value within a range of the limiting section 73*f*, and thereafter, division Qa'/Qra of the output of the main pump actual flow rate calculation section 71 and the main pump flow rate Qa' is performed by the subtractor section 73*b*. An output of the subtractor section 73*b* is sent to the multiplier sections 73*c*, 73*d* and 73*e*.

In short, in the demanded flow rate correction section 73, the boom raising demanded flow rate Qr1 and the arm crowding demanded flow rate Qr2 are re-distributed at the ratio of Qr1 and Qr2 within the range of the flow rate Qa' that is actually delivered from the main pump 2.

For example, in the case where Qa' is 30 L/min, Qr1 is 20 L/min and Qr2 is 40 L/min, since Qra=Qr1+Qr2+Qr3=60 L/min, Qa'/Qra=½ is established.

The corrected boom raising demanded flow rate Qr1' becomes Qr1'=Qr1×½=20 L/min×½=10 L/min, and the corrected arm crowding demanded flow rate Qr2' becomes Qr2'=Qr2×½=40 L/min×½=20 L/min.

The boom raising operation pressure a1 and the arm crowding operation pressure b1 are sent as outputs Pi_a1 and Pi_b1 of the pressure sensors 41*a*1 and 41*b*1 also to the meter-in opening calculation section 74, by which they are converted into and outputted as meter-in opening areas Am1 and Am2 by and from the tables 74*a* and 74*b*, respectively.

The target differential pressure calculation section 75 calculates pressure losses ΔPsd1, ΔPsd2 and ΔPsd3 to be generated at the meter-in opening of the directional control valves from the corrected demanded flow rates Qr1', Qr2' and Qr3' and the meter-in opening areas Am1, Am2 and Am3.

In the case where a boom raising action and an arm crowding operation are performed simultaneously, the corrected demanded flow rates Qr1' and Qr2' and the meter-in opening areas Am1 and Am2 are inputted to the calculating sections 75*a* and 75*b*, by which ΔPsd1 and ΔPsd2 are calculated in accordance with the following expressions.

[Math. 3]

$$\Delta Psd1 = \frac{\rho}{2} \cdot \frac{(Qr1')^2}{C^2 \cdot (Am1)^2}$$

$$\Delta Psd2 = \frac{\rho}{2} \cdot \frac{(Qr2')^2}{C^2 \cdot (Am2)^2}$$

Although also ΔPsd3 is calculated similarly, since ΔPsd3=0 similarly as in the case where all levers are neutral, a higher one of ΔPsd1 and ΔPsd2 is selected as ΔPsd by the maximum value selecting section 75*d* and is converted into a command pressure Pi_ul to the solenoid proportional pressure reducing valve 22 for the unloading valve by the table 75*e* and outputted as a command value. Meanwhile, ΔPsd is outputted to the adding section 81.

An output of the solenoid proportional pressure reducing valve 22 for the unloading valve is introduced to the pressure receiving portion 15*c* of the unloading valve 15 and acts to increase the set pressure of the unloading valve 15 by ΔPsd.

As described hereinabove, in the case where the load pressure of the boom cylinder 3*a*>load pressure of the arm cylinder 3*b* is satisfied, since the load pressure Pl1 of the boom cylinder 3*a* is introduced as Plmax to the pressure receiving portion 15*a* of the unloading valve 15, the set pressure of the unloading valve 15 is set to Plmax+ΔPsd+spring force, namely, Pl1 (load pressure of the boom cylinder 3*a*)+ΔPsd (a greater one of the differential pressure generated at the meter-in opening of the directional control valve 6*a* associated with the boom cylinder 3*a* and the differential pressure generated at the meter-in opening of the directional control valve 6*b* associated with the arm cylinder 3*b*)+spring force, and interrupts the line along which hydraulic fluid of the hydraulic fluid supply line 5 is discharged to the tank.

On the other hand, although the adding section 81 adds the highest load pressure Plmax and ΔPsd described above to calculate the target pump pressure Psd=Plmax+ΔPsd, in the case where the load pressure of the boom cylinder 3*a*>load pressure of the arm cylinder 3*b*, since Plmax=Pl1 as described hereinabove, the target pump pressure Psd=Pl1 (load pressure of the boom cylinder 3*a*)+ΔPsd (a greater one of the differential pressure generated at the meter-in opening of the directional control valve 6*a* associated with the boom cylinder 3*a* and the differential pressure generated at the meter-in opening of the directional control valve 6*b* associated with the arm cylinder 3*b*) is calculated and outputted to the differencing section 82.

The differencing section 82 calculates the difference between the target pump pressure Psd described above and the pressure of the hydraulic fluid supply line 5 detected by the pressure sensor 42, namely, the actual pump pressure Ps, as ΔP=Psd−Ps and outputs it to the main pump target tilting angle calculation section 83.

Although, in the main pump target tilting angle calculation section 83, the differential pressure ΔP is converted into a target displacement change amount Δq by the table 83*a*, in the case where a boom raising operation and an arm crowding operation are performed from the state in which all levers are neutral, since, at the beginning of action, the actual pump pressure Ps is kept to a value smaller than the target pump pressure Ps, which is described in the case (a) Where all operation levers are neutral, ΔP=Psd−Ps has a positive value.

Since the table 83*a* has such a characteristic that, in the case where the differential pressure ΔP has a positive value, also the target displacement change amount Δq has a positive value, also the target displacement change amount Δq becomes positive.

Although the adding section 83*b* and the delay element 83*c* add the target displacement change amount Δq described above to the target displacement q' one control step before to calculate new q, since the target displacement change amount Δq is in the positive as described above, the target displacement q' increases.

Further, the target displacement q' is converted into a command pressure or command value Pi_fc to the solenoid proportional pressure reducing valve 21 for main pump tilting controlling by the table 83*e*. The output Pi_fc of the solenoid proportional pressure reducing valve 21 for main pump tilting controlling is introduced to the pressure receiving portion 11*h* of the flow controlling tilting control valve 11*i* for flow rate controlling in the regulator 11 of the variable displacement main pump 2, and the tilting angle of the variable displacement main pump 2 is controlled so as to become equal to the target displacement q'.

Increase of the target displacement q' and the delivery amount of the variable displacement main pump 2 continues until after the actual pump pressure Ps becomes equal to the target pump pressure Psd, and finally, the actual pump pressure Ps is kept in a situation in which it is equal to the target pump pressure Psd.

In this manner, the variable displacement main pump 2 compares a pressure loss that may possibly occur at the meter-in opening of the directional control valve 6*a* associated with the boom cylinder 3*a* and a pressure loss that may possibly occur at the meter-in opening of the directional control valve 6*b* associated with the arm cylinder 3*b* with each other, calculates a greater one as a target differential pressure ΔPsd, and increases or decreases the flow rate using a pressure of addition of the target differential pressure ΔPsd to the highest load pressure Plmax as a target pressure. Therefore, load sensing control in which the target differential pressure is variable is performed.

~Advantage~

According to the present embodiment, the following advantages are obtained.

1. In the present embodiment, since the hydraulic drive system is configured such that flow dividing control of the plurality of the directional control valves 6*a*, 6*b* and 6*c* is performed by using the plurality of pressure compensating valves (namely, flow sharing valves) 7*a*, 7*b* and 7*c* arranged in the downstream side of the plurality of directional control valves 6*a*, 6*b* and 6*c* for controlling the pressure in the downstream side of the meter-in openings of the plurality of directional control valves 6*a*, 6*b* and 6*c* such that the pressures in the downstream sides of the meter-in openings of the plurality of directional control valves 6*a*, 6*b* and 6*c* becomes equal to the highest load pressure, even in the case where the differential pressures, namely, the meter-in pressure losses, across the directional control valves 6*a*, 6*b* and 6*c* associated with the actuators 3*a*, 3*b* and 3*c* are very small, flow dividing control of the plurality of directional control valves 6*a*, 6*b* and 6*c* can be performed stably.

2. Further, in the present embodiment, the controller 70 calculates a meter-in pressure loss of each of the directional control valves 6*a*, 6*b* and 6*c* associated with the actuators 3*a*, 3*b* and 3*c*, selects a maximum value of the meter-in pressure losses (namely, calculates the meter-in pressure loss of a specific directional control valve), and outputs the pressure loss of the maximum value as the target differential pressure ΔPsd to control the set pressure Plmax+ΔPsd+spring force of the unloading valve 15. Consequently, since the set pressure of the unloading valve 15 is controlled to the sum value of the highest load pressure, the target differential pressure ΔPsd therefor and the spring force, for example, even in the case where the meter-in opening of an actuator that is not the highest load pressure actuator is throttled extremely small by the directional control valve associated with the actuator, the set pressure of the unloading valve 15 is controlled carefully in response to the pressure loss at the meter-in opening of the directional control valve. As a result, even in the case where the demanded flow rate changes suddenly at the time of transition from a combined operation including a half operation of an operation lever corresponding to the directional control valve whose meter-in loss indicates a maximum value to a half single operation or in a like case and the pump pressure increases suddenly due to insufficient responsiveness of pump flow rate control, bleed-off loss in which hydraulic fluid is discharged uselessly from the unloading valve 15 to the tank can be suppressed to the minimum and reduction of the energy efficiency can be suppressed and besides a sudden change of the actuator speed by a sudden change of the flow rate of the hydraulic fluid supplied to each actuator can be prevented to suppress occurrence of an unpleasant shock thereby implement superior combined operability.

3. Further, in the present embodiment, even in the case where the differential pressure across each of the directional control valves 6*a*, 6*b* and 6*c* is very small as described above, flow dividing control of the plurality of directional control valves 6*a*, 6*b* and 6*c* can be performed stably. Besides, since the set pressure of the unloading valve 15 can be controlled carefully in response to the pressure loss at the meter-in opening of each of the directional control valves 6*a*, 6*b* and 6*c*, it becomes possible to make the final meter-in opening of each of the directional control valves 6*a*, 6*b* and 6*c*, namely, the meter-in opening area at a full stroke of the main spool, extremely great. Consequently, it is possible to reduce the meter-in loss and implement a high energy efficiency.

4. In such conventional load sensing control as disclosed in Patent Document 1, a hydraulic pump increases or decreases the delivery flow rate thereof such that the LS differential pressure becomes equal to a target LS differential pressure determined in advance. However, in the case where the meter-in final opening of the main spool is made extremely great, the LS differential pressure becomes substantially equal to zero as described hereinabove. Therefore, the conventional load sensing control has a problem that the hydraulic pump delivers a maximum flow rate within an allowable range, resulting in failure to perform flow rate control according to each operation lever input.

In the present embodiment, the controller 70 calculates a target differential pressure ΔPsd for adjusting the set pressure of the unloading valve 15 and controls the delivery flow rate of the main pump 2 using the target differential pressure ΔPsd such that the delivery pressure of the main pump 2 detected by the pressure sensor 42 becomes equal to the sum of the highest load pressure and the target differential pressure ΔPsd. Therefore, even if the final meter-in opening of each of the directional control valves 6*a*, 6*b* and 6*c* is made extremely great, such a problem that pump flow rate control cannot be performed as in the case in which the LS differential pressure is set to zero in the conventional load sensing control does not occur, and the delivery flow rate of the main pump 2 can be controlled in response to an operation lever input.

5. Furthermore, since the main pump 2 performs load sensing control that takes the meter-in pressure loss into consideration and each actuator delivers required hydraulic fluid to the main pump 2 just enough in response to an input of each operation lever, a hydraulic system in which the energy efficiency is high in comparison with flow rate control, in which the target flow rate is determined simply depending upon each operation lever input can be implemented.

6. Further, in comparison with the conventional technology disclosed in Patent Document 2, the quantity of solenoid proportional pressure reducing valves and pressure sensors for load pressure detection of each actuator can be suppressed, and the cost relating to electronic control can be suppressed.

Second Embodiment

A hydraulic drive system for a construction machine according to a second embodiment of the present invention is described below focusing on differences thereof from the first embodiment.

~Structure~

Figure 12:
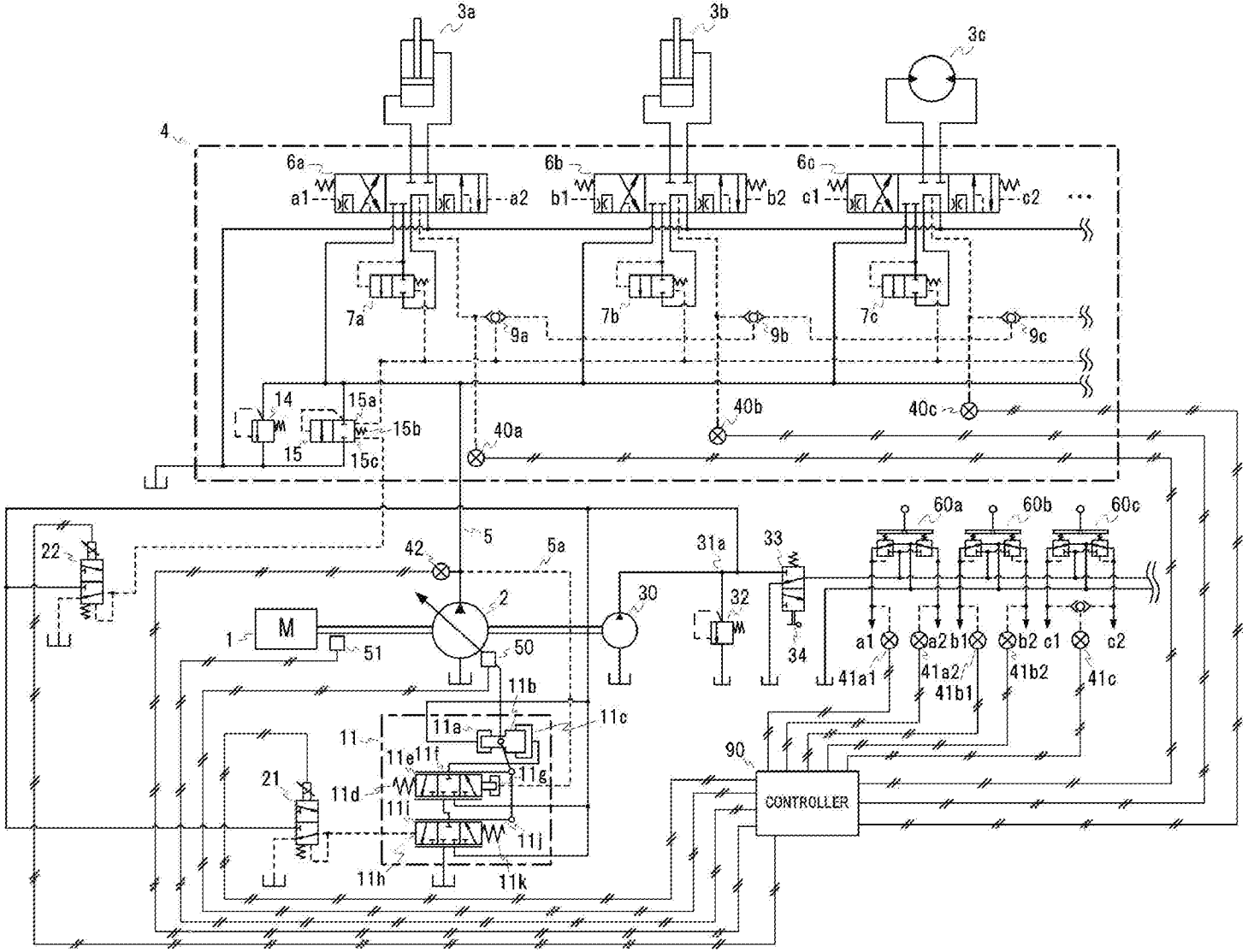
FIG. 12 is a view depicting a structure of a hydraulic drive system for a construction machine according to a second embodiment of the present invention.

FIG. 12 is a view depicting a structure of the hydraulic drive system for a construction machine according to the second embodiment.

Referring to FIG. 12, the second embodiment is configured such that, in the first embodiment, the pressure sensor 40 for detecting the highest load pressure is removed and pressure sensors 40*a*, 40*b* and 40*c* for detecting a load pressure of a plurality of actuators 3*a*, 3*b*, 3*c*, are provided and besides a controller 90 is provided in place of the controller 70.

Figure 13:
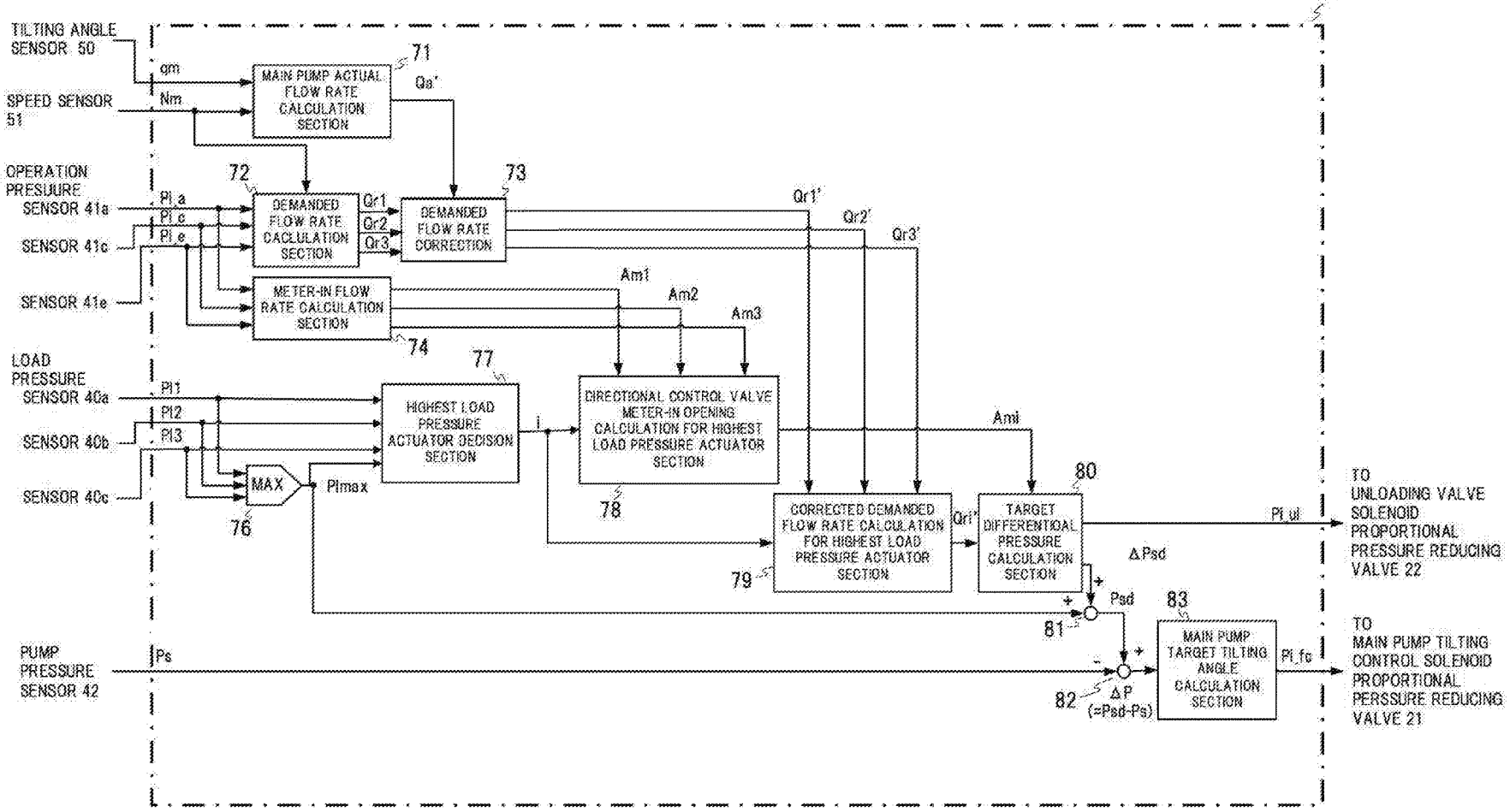
FIG. 13 is a functional block diagram of a controller in the hydraulic drive system of the second embodiment.

FIG. 13 depicts a functional block diagram of the controller 90 in the present embodiment.

Referring to FIG. 13, the difference from the first embodiment depicted in FIG. 5 resides in that, in place of the target differential pressure calculation section 75, a maximum value selecting section 76, a highest load pressure actuator decision section 77, a directional control valve meter-in opening calculation section 78 for the highest load pressure actuator, a corrected demanded flow rate calculation section 79 for the highest load pressure actuator and a target differential pressure calculation section 80 are provided. In the following, such functiona are described.

Referring to FIG. 13, outputs of the pressure sensors 40*a*, 40*b* and 40*c* indicative of load pressures of the actuators are sent to the maximum value selecting section 76 and the highest load pressure actuator decision section 77.

The highest load pressure Plmax that is an output of the maximum value selecting section 76 is sent to the highest load pressure actuator decision section 77 together with outputs Pl1, Pl2 and Pl3 of the pressure sensors 40*a*, 40*b* and 40*c* described hereinabove, and the highest load pressure actuator decision section 77 sends an identifier i indicative of the highest load pressure actuator to the directional control valve meter-in opening calculation section 78 of the highest load pressure actuator and a corrected demanded flow rate calculation section 79 of the highest load pressure actuator. Further, the highest load pressure Plmax is sent to the adding section 81.

The directional control valve meter-in opening calculation section 78 of the highest load pressure actuator receives the identifier i and meter-in opening areas Am1, Am2 and Am3 that are outputs of the meter-in opening calculation section 74 as inputs thereto and outputs a meter-in opening area Ami for the directional control valve of the highest load pressure actuator.

The corrected demanded flow rate calculation section 79 of the highest load pressure actuator receives the identifier i and the corrected demanded flow rages Qr1', Qr2' and Qr3' that are outputs of the demanded flow rate correction section 73 as inputs thereto and outputs a corrected demanded flow rate Qri' of the highest load pressure actuator.

The meter-in opening area Ami of the directional control valve of the highest load pressure actuator and the corrected demanded flow rate Qri' of the highest load pressure actuator are sent to the target differential pressure calculation section 80, and the target differential pressure calculation section 80 outputs a target differential pressure ΔPsd to the adding section 81 and outputs a command pressure or command value Pi_ul to the solenoid proportional pressure reducing valve 22.

In the demanded flow rate calculation section 72, demanded flow rate correction section 73 and meter-in opening calculation section 74, maximum value selecting section 76, highest load pressure actuator decision section 77, directional control valve meter-in opening calculation section 78, corrected demanded flow rate calculation section 79 and target differential pressure calculation section 80, the controller 90 calculate a demanded flow rate for each of the plurality of the actuators 3*a*, 3*b* and 3*c* and a meter-in opening area of each of the plurality of directional control valves 6*a*, 6*b* and 6*c* on the basis of input amounts of the operation levers of the plurality of operation lever devices 60*a*, 60*b* and 60*c*, calculate a meter-in pressure loss of a specific directional control valve in the plurality of the directional control valves 6*a*, 6*b* and 6*c* on the basis of the meter-in opening areas and the demanded flow rates, and output the pressure loss as a target differential pressure ΔPsd to control the set pressure of the unloading valve 15.

Further, in the maximum value selecting section 76, highest load pressure actuator decision section 77, directional control valve meter-in opening calculation section 78, corrected demanded flow rate calculation section 79 and target differential pressure calculation section 80, the controller 90 calculate, as a meter-in pressure loss of the specific directional control valve, a meter-in pressure loss of a directional control valve associated with the actuator of the highest load pressure detected by the highest load pressure detection device (namely by the shuttle valves 9*a*, 9*b* and 9*c*) in the plurality of directional control valves 6*a*, 6*b* and 6*c*, and outputs the pressure loss as the target differential pressure ΔPsd to control the set pressure of the unloading valve 15.

Figure 14:
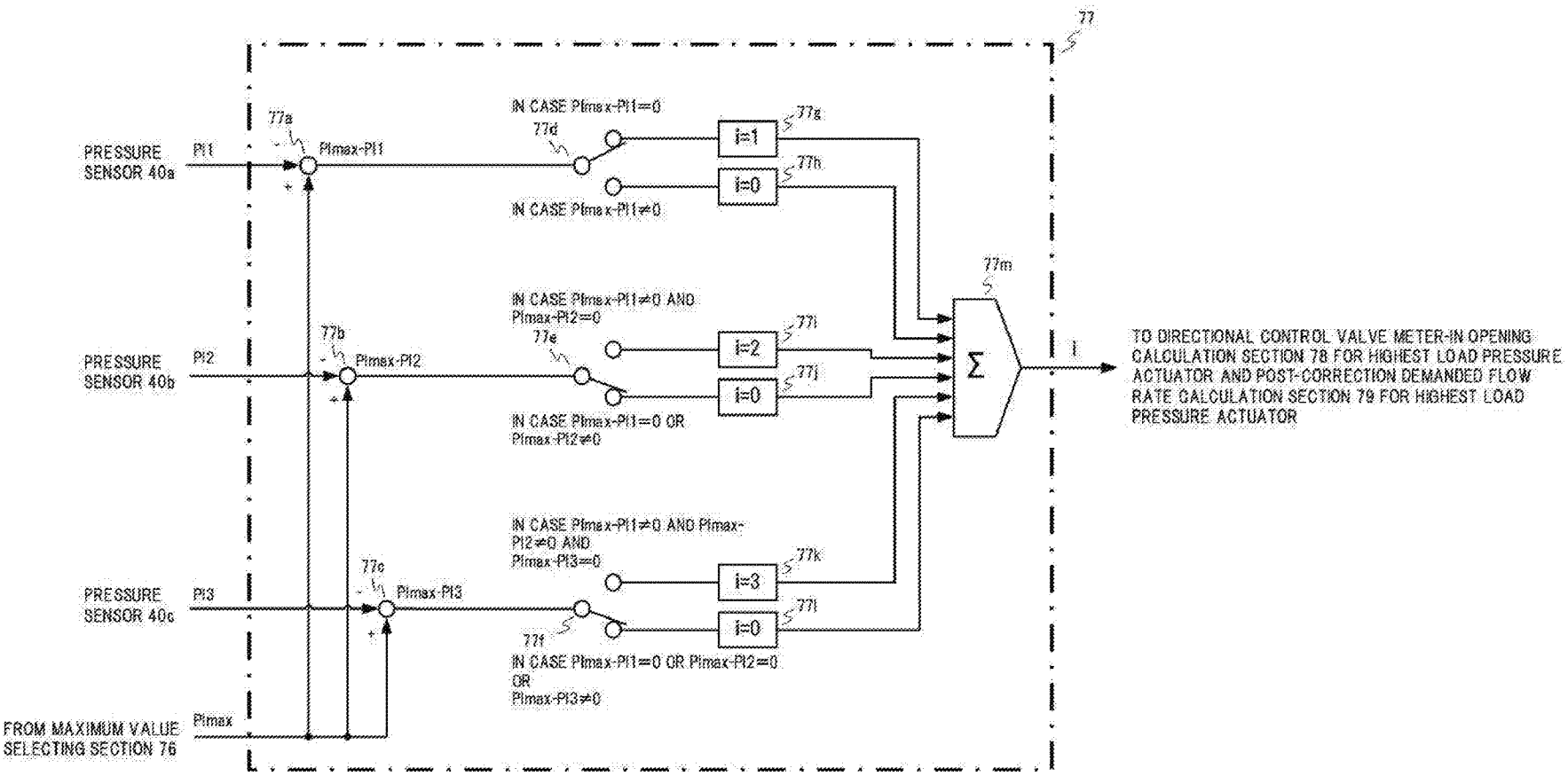
FIG. 14 is a functional block diagram of a highest load pressure actuator decision section in the controller.

FIG. 14 depicts a functional block diagram of the highest load pressure actuator decision section 77.

In the decision section 77, load pressures Pl1, Pl2 and Pl3 of the actuators inputted from the pressure sensors 40*a*, 40*b* and 40*c* are sent to the negative side of differencing sections 77*a*, 77*b* and 77*c* while the highest load pressure Plmax from the maximum value selecting section 76 is sent to the positive side of the differencing sections 77*a*, 77*b* and 77*c*, and the differencing sections 77*a*, 77*b* and 77*c* output Plmax-Pl1, Plmax-Pl2 and Plmax-Pl3 to deciding sections 77*d*, 77*e* and 77*f*, respectively. Each of the deciding sections 77*d*, 77*e* and 77*f* is switched to an ON state, in the figure, to the upper side, in the case where the decision sentence is true but is switched to an OFF state, in the figure, to the lower side, in the case where the decision sentence is false.

Since FIG. 14 depicts a case of Plmax=Pl1, namely, a case where Plmax−Pl1 is zero, in this case, the calculating section 77*g* is selected and i=1 is outputted as the identifier i to a summing section 77*m*. On the other hand, since, in the deciding sections 77*e* and 77*f*, the decision state is false, calculating sections 77*j* and 77*l* are selected, respectively, and i=0 is sent as the identifier i to the summing section 77*m*. The summing section 77*m* sums up the outputs of the calculating sections 77*g*, 77*j* and 77*l* and outputs i=1.

In this manner, in the case of Plmax=Pl1, i=1 is outputted. Similarly, in the case of Plmax=Pl2, i=2 is outputted, and in the case of Plmax=Pl3, i=3 is outputted.

Figure 15:
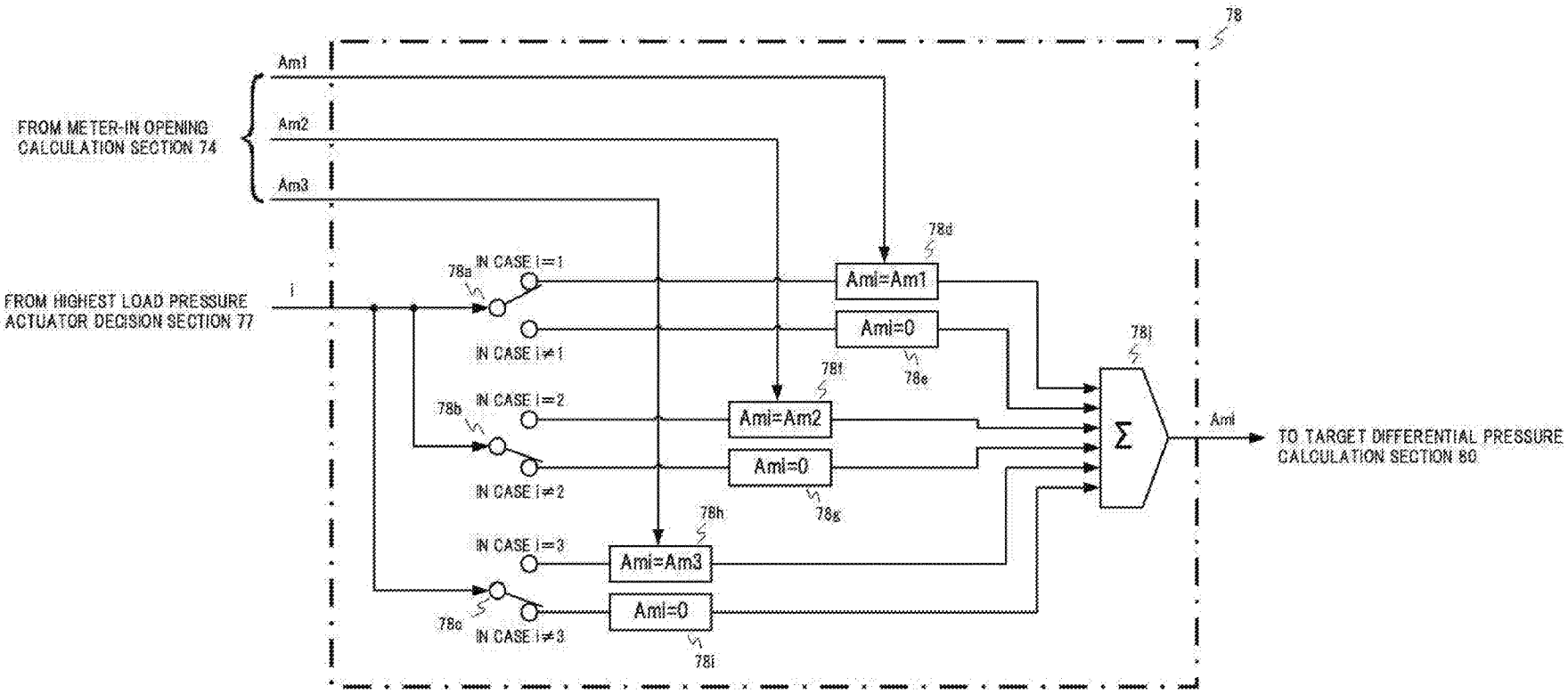
FIG. 15 is a functional block diagram of a directional control valve meter-in opening calculation section of a highest load pressure actuator in the controller.

FIG. 15 depicts a functional block diagram of the directional control valve meter-in opening calculation section 78 of the highest load pressure actuator.

In the calculation section 78, the identifier i inputted from the highest load pressure actuator decision section 77 is sent to deciding sections 78*a*, 78*b* and 78*c* while meter-in opening areas Am1, Am2 and Am3 inputted from the meter-in opening calculation section 74 are sent to the deciding sections 78*d*, 78*f* and 78*h*, respectively. FIG. 15 depicts a case of i=1.

Since i=1, the deciding section 78*a* indicates an ON state an is switched to the upper side in the figure, by which the calculating section 78*d* is selected and sends Am1 as the meter-in opening area Ami to a summing section 78*j*. Meanwhile, the deciding sections 78*b* and 78*c* are in an OFF state and are switched to the lower state in the figure, by which calculating sections 78*g* and 78*i* are selected and both send zero as the meter-in opening area Ami to the summing section 78*j*. The summing section 78*j* outputs Am1+0+0=Am1 as the meter-in opening area Ami.

Similarly, in the case of i=2, Am2 is outputted, and in the case of i=3, Am3 is outputted, as the meter-in opening area Ami.

Figure 16:
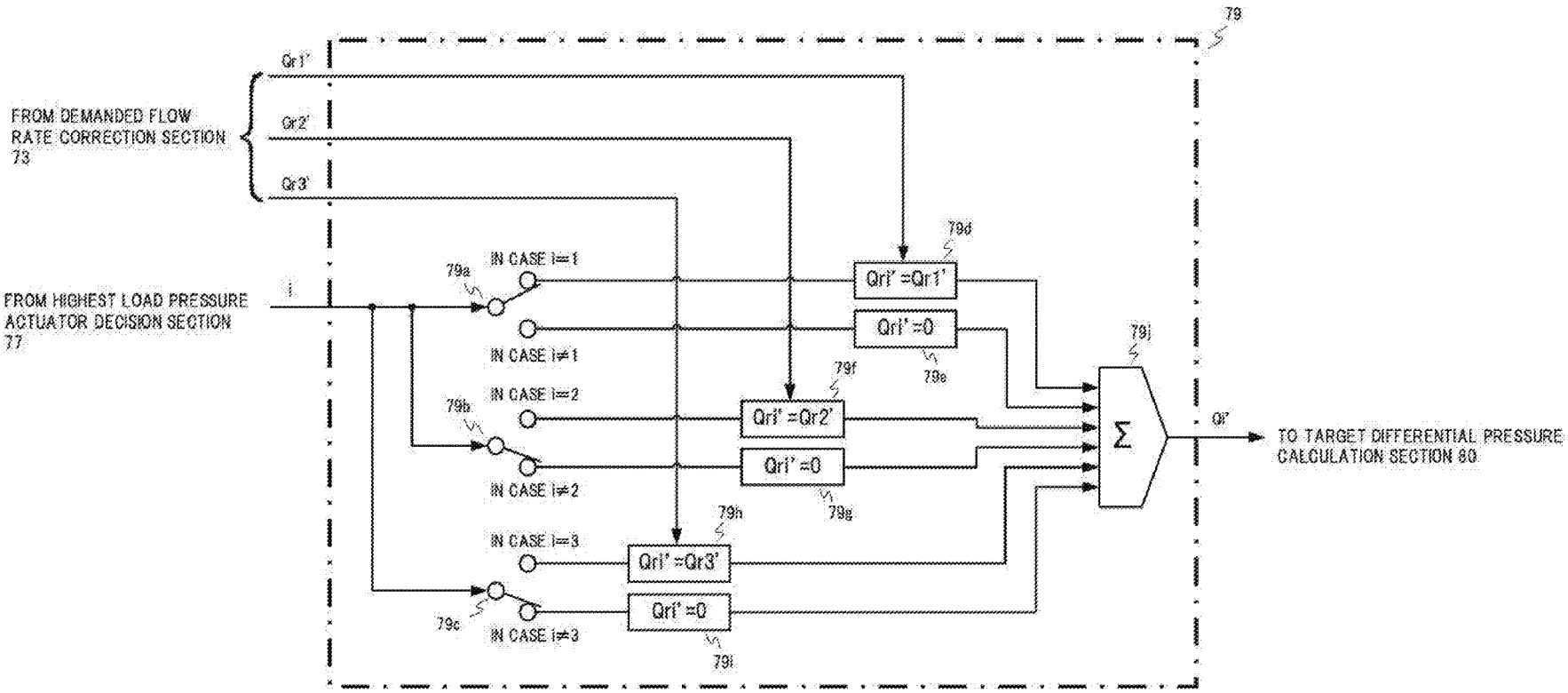
FIG. 16 is a functional block diagram of a corrected demanded flow rate calculation section of the highest load pressure actuator in the controller.

FIG. 16 depicts a functional block diagram of the corrected demanded flow rate calculation section 79 of the highest load pressure actuator.

In the calculation section 79, an identifier i inputted from the highest load pressure actuator decision section 77 is sent to deciding sections 79*a*, 79*b* and 79*c* while corrected demanded flow rates Qr1', Qr2' and Qr3' inputted from the demanded flow rate correction section 73 are sent to calculating sections 79*d*, 79*g* and 79*h*, respectively. FIG. 16 depicts a case of i=1.

Since i=1, the deciding section 79*a* indicates an ON state and is switched to the upper side in the figure, and the calculating section 79*d* is selected and sends Qr1' as the corrected demanded flow rate Qri' to a summing section 79*j*. Meanwhile, the deciding sections 79*b* and 79*c* indicate an OFF state and are switched to the lower side in the figure, and the calculating sections 79*g* and 79*i* are selected and both send zero as the corrected demanded flow rate Qri' to the summing section 79*j*. The summing section 79*j* outputs Qr1'+0+0 as the corrected demanded flow rate Qri'.

Similarly, in the case of i=2, Qr2' is outputted, and in the case of i=3, Qr3' is outputted, as the corrected demanded flow rate Qri'.

Figure 17:
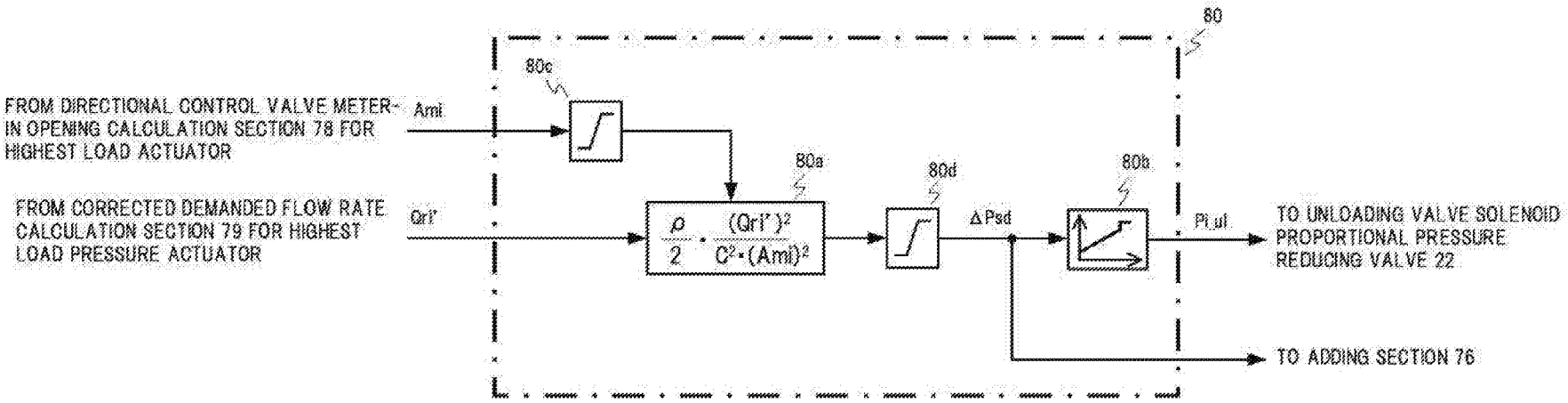
FIG. 17 is a functional block diagram of a target differential pressure calculation section in the controller.

FIG. 17 depicts a functional block diagram of the target differential pressure calculation section 80.

In the calculation section 80, a corrected demanded flow rate Qri' inputted from the corrected demanded flow rate calculation section 79 of the highest load pressure actuator is sent to a calculating section 80*a*, and a meter-in opening area Ami inputted from the directional control valve meter-in opening calculation section 78 of the highest load pressure actuator is sent to the calculating section 80*a* through a limiting section 80*c*. The calculating section 80*a* calculates a meter-in pressure loss of the directional control valve of the highest load pressure actuator, namely, the adjustment pressure for variably controlling the set pressure of the unloading valve 15, in accordance with the expression given below. The target differential pressure ΔPsd having passed a limiting section 80*d* is outputted to a table 80*b* and the external adding section 81. Here, C is a contraction coefficient determined in advance, and ρ is a density of the hydraulic fluid.

[Math. 4]

$$\Delta Psd = \frac{\rho}{2} \cdot \frac{(Qri')^2}{C^2 \cdot (Ami)^2}$$

In the table 80*b*, the target differential pressure ΔPsd is converted into a command pressure Pi_ul to the solenoid proportional pressure reducing valve 22 and outputs the command pressure Pi_ul as a command value.

~Action~

While, in the first embodiment, meter-in pressure losses ΔPsd1, ΔPsd2 and ΔPsd3 of the directional control valves 6*a*, 6*b* and 6*c* associated with the boom cylinder 3*a*, arm cylinder 3*b* and swing motor 3*c* are calculated, respectively, and a maximum among them is calculated as the overall target differential pressure ΔPsd, in the target differential pressure calculation section 80 in the second embodiment, the highest load pressure actuator decision section 77 decides the highest load pressure actuator and the target differential pressure calculation section 80 calculates the meter-in pressure loss of the highest load pressure actuator as the overall target differential pressure ΔPsd.

The unloading valve 15 is controlled to a set pressure that depends upon the target differential pressure ΔPsd, the highest load pressure Plmax and the spring force similarly as in the first embodiment. Further, the adding section 81 adds the target differential pressure ΔPsd to the highest load pressure Plmax that is an output of the maximum value selecting section 76 to calculate a target pump pressure Psd and outputs the target pump pressure Psd to the differencing section 82.

~Advantage~

1. Also in the present embodiment, advantages same as the advantages 1, 3, 4 and 5 of the first embodiment are achieved, and the following advantage similar to the advantage 2 is achieved.

2. In the present embodiment, the controller 90 calculates the meter-in opening areas of the plurality of directional control valves 6*a*, 6*b* and 6*c* on the basis of input amounts of the operation levers, calculates, on the basis of the opening area of a directional control valve (namely, specific directional control value) associated with the highest load pressure actuator in the plurality of directional control valves 6*a*, 6*b* and 6*c* and the demanded flow rate for the directional control valve (namely, the specific directional control valve), the meter-in pressure loss of the directional control valve (namely, the specific directional control valve), and outputs the pressure loss as the target differential pressure ΔPsd to control the set pressure Plmax+ΔPsd+spring force of the unloading valve 15. Consequently, since the set pressure of the unloading valve 15 is controlled to a value of the sum of the highest load pressure and the target differential pressure ΔPsd therefor, in such a case that, by a half operation of the directional control valve or specific directional control valve associated with the highest load pressure actuator or a like operation, the meter-in opening of the directional control valve is throttled, the set pressure of the unloading valve 15 is controlled carefully. As a result, for example, even in the case where the demanded flow rate changes suddenly at the time of transition from a combined operation including a half operation of the directional control valve associated with the highest load pressure actuator or the like to a half single operation or in a like case and the pump pressure increases suddenly due to insufficient responsiveness of pump flow rate control, bleed-off loss in which hydraulic fluid is discharged uselessly from the unloading valve 15 to the tank can be suppressed to the minimum and besides a sudden change of the actuator speed by a sudden change of the flow rate of the hydraulic fluid supplied to each actuator can be suppressed thereby implement superior combined operability.

Third Embodiment

A hydraulic drive system for a construction machine according to a third embodiment of the present invention is described below focusing on differences from the first embodiment.

~Structure~

Figure 18:
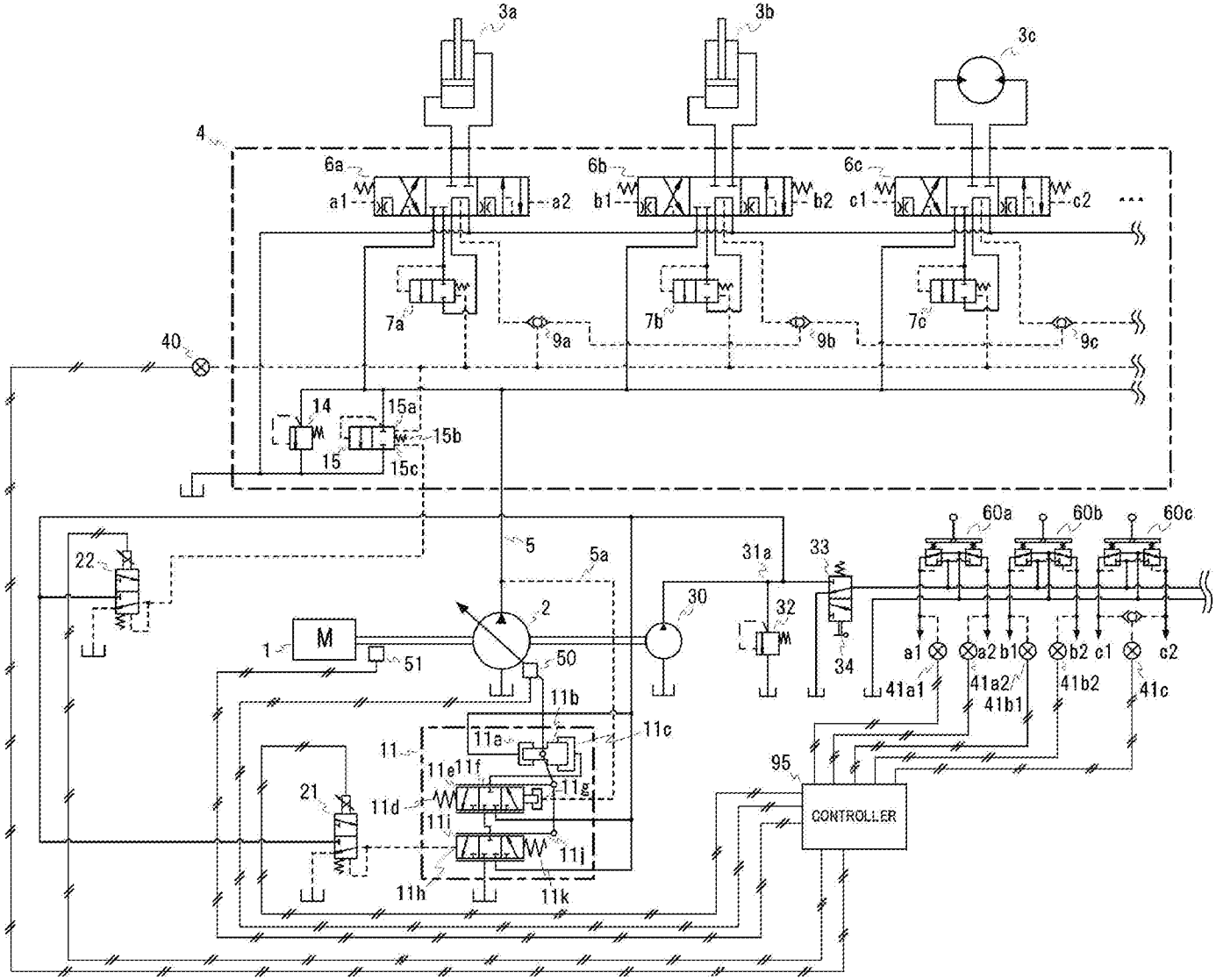
FIG. 18 is a view depicting a structure of a hydraulic drive system for a construction machine according to a third embodiment of the present invention.

FIG. 18 is a view depicting a structure of the hydraulic drive system for a structure machine according to the third embodiment.

Referring to FIG. 18, the third embodiment is configured such that, in the first embodiment, the pressure sensor 42 for detecting the pressure of the hydraulic fluid supply line 5, namely, the pump pressure, is removed and a controller 95 is provided in place of the controller 70.

Figure 19:
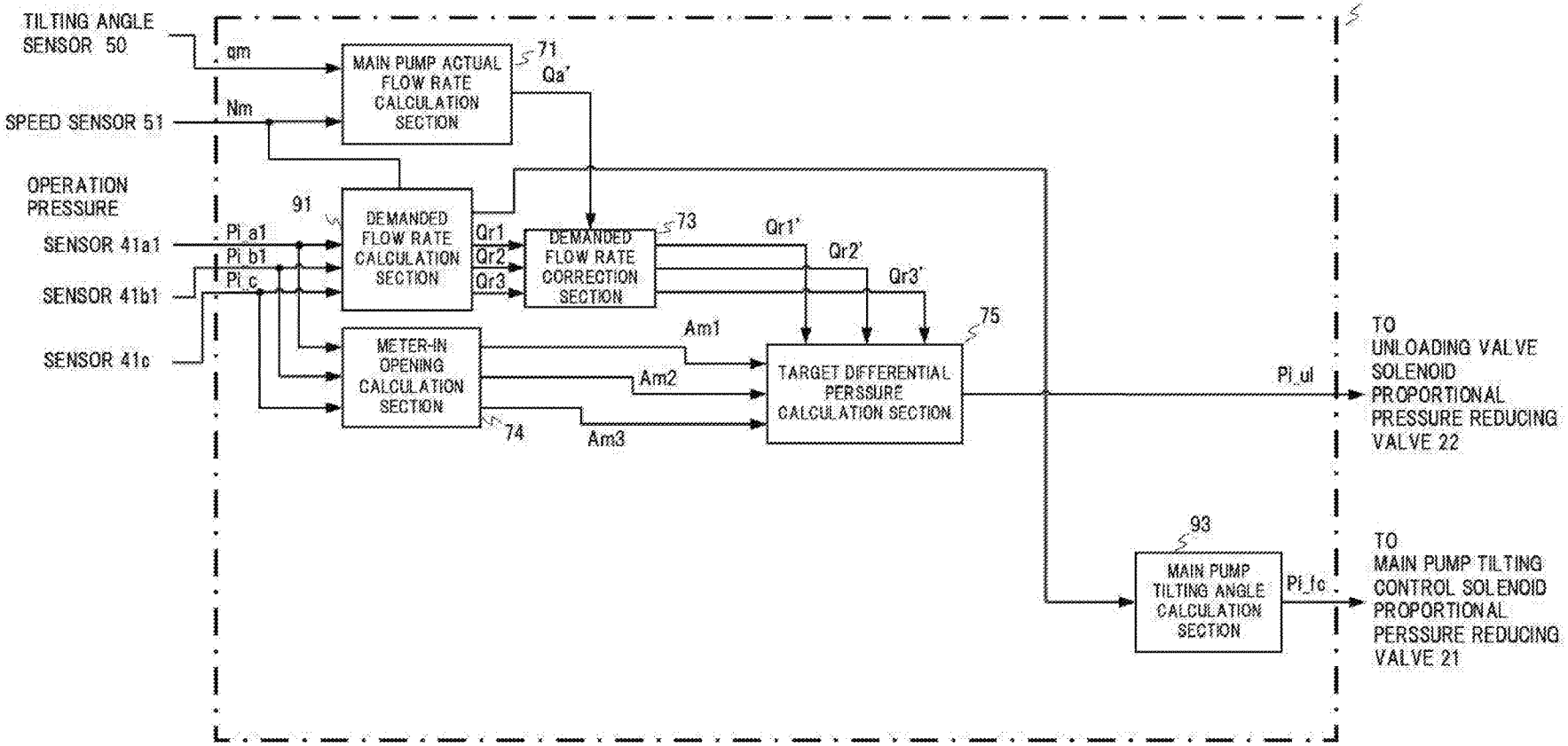
FIG. 19 is a functional block diagram of a controller in the hydraulic drive system of the third embodiment.

FIG. 19 depicts a functional block diagram of the controller 95 in the present embodiment.

Referring to FIG. 19, the different structure from the first embodiment depicted in FIG. 5 is that a demanded flow rate calculation section 91 and a main pump target tilting angle calculation section 93 are provided in place of the demanded flow rate calculation section 72 and the main pump target tilting angle calculation section 83 and the adding section 81 and the differencing section 82 are removed.

In the demanded flow rate calculation section 91 and the main pump target tilting angle calculation section 93, the controller 95 calculate the sum of the demanded flow rates of the plurality of actuators 3*a*, 3*b* and 3*c* on the basis of input amounts of the operation levers of the plurality of operation lever devices 60*a*, 60*b* and 60*c*, calculate a command value Pi_fc for making the delivery flow rate of the main pump 2 (namely, a hydraulic pump) equal to the sum the demanded flow rates, and outputs the command value Pi_fc to the regulator 11 (namely, a pump regulation device) to control the delivery flow rate of the main pump 2.

Figure 20:
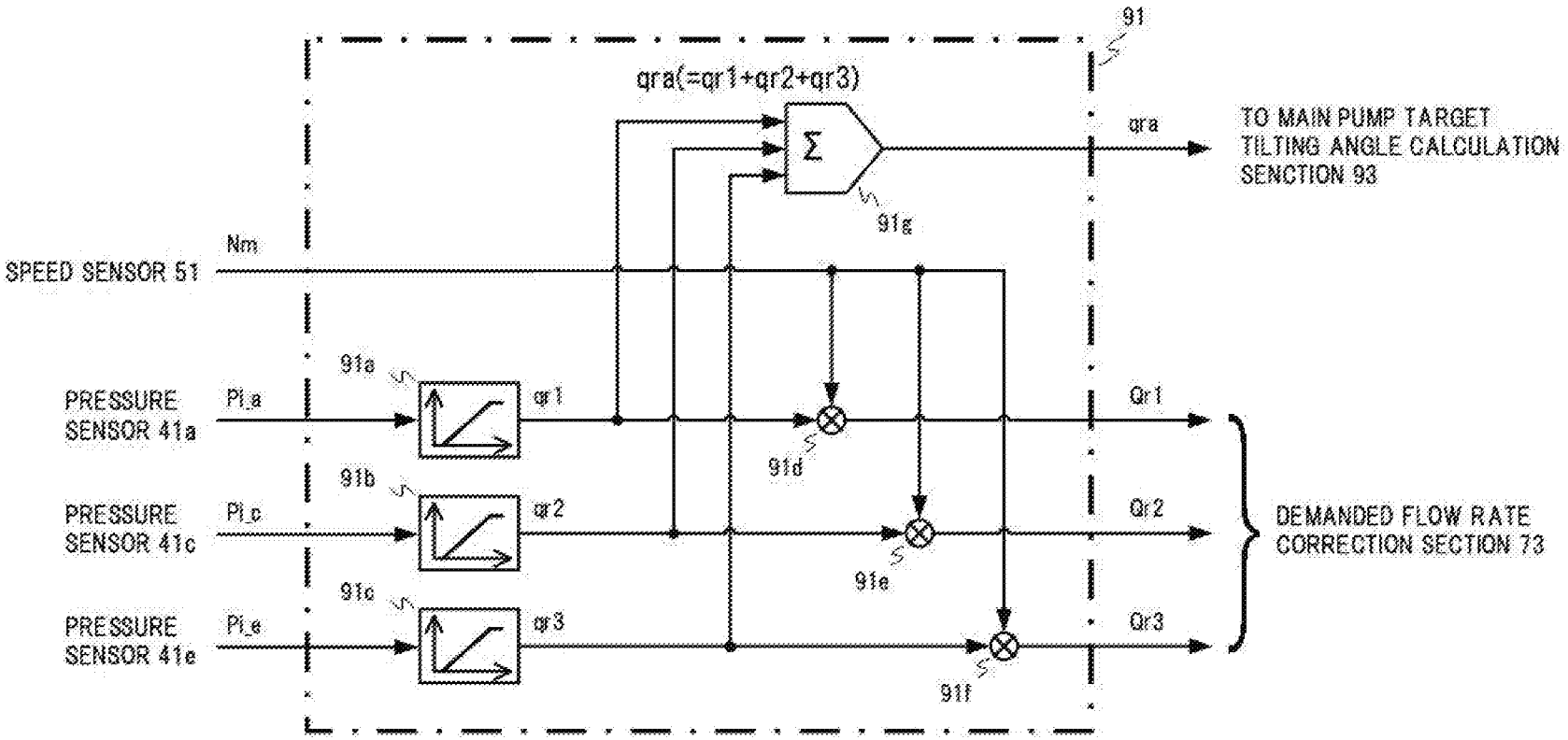
FIG. 20 is a functional block diagram of a demanded flow rate calculation section in the controller.

FIG. 20 depicts a functional block diagram of the demanded flow rate calculation section 91.

Referring to FIG. 20, operation pressures Pi_a1, Pi_b1 and Pi_c inputted from the pressure sensors 41*a*1, 41*b*1 and 41*c* are converted into demanded tilting angles or displacements qr1, qr2 and qr3 by tables 91*a*, 91*b* and 91*c*, and the demanded tilting angles qr1, qr2 and qr3 and an input Nm from the speed sensor 51 are multiplied by multipliers 91*d*, 91*e* and 91*f* to calculate demanded flow rates Qr1, Qr2 and Qr3, respectively. Further, a summing section 91*g* calculates qra=qr1+qr2+qr3 and outputs the sum qra of the demanded tilting angles to the main pump target tilting angle calculation section 93.

Figure 21:
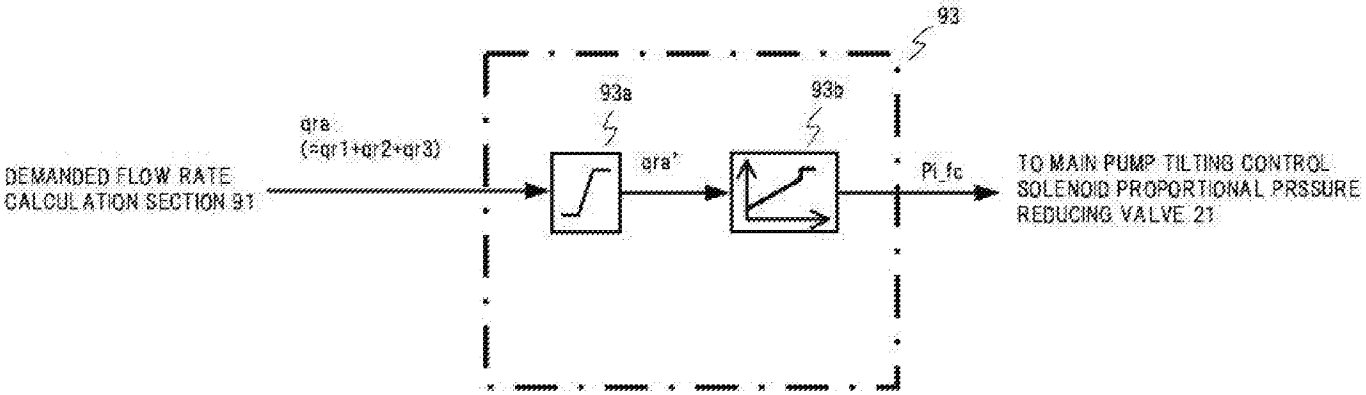
FIG. 21 is a functional block diagram of a main pump target tilting angle calculation section in the controller.

FIG. 21 depicts a functional block diagram of the main pump target tilting angle calculation section 93.

The input qra=qr1+qr2+qr3 from the demanded flow rate calculation section 91 is limited to a value between a minimum value and a maximum value of the tilting of the main pump 2 by a limiting section 93*a* and is converted into a command pressure Pi_fc to the solenoid proportional pressure reducing valve 21 by a table 93*b* and then outputted as a command value.

~Action~

While, in the first embodiment, so-called load sensing control of controlling the delivery flow rate of the main pump 2 such that the pressure of the hydraulic fluid supply line 5, namely, the pump pressure, becomes the highest load pressure Plmax+meter-in pressure loss of the highest load pressure actuator is performed, in the second embodiment, the main pump target tilting angle calculation section 93 determines the delivery flow rate of the main pump 2 only with the demanded tilting angle qra that depends only upon input amounts of the operation levers.

~Advantage~

1. Also in the present embodiment, advantages same as the advantages 1 to 3 and 6 of the first embodiment are achieved, and also the following advantage is achieved.

2. In the present embodiment, since the main pump 2 performs flow rate control in which the sum of demanded flow rates of the plurality of directional control valves 6*a*, 6*b* and 6*c* is calculated on the basis of input amounts of the operation levers to determine a target flow rate, a more stable hydraulic system can be implemented in comparison with the case in which load sensing control that is a kind of feedback control demonstrated by the first embodiment is performed. Further, the pressure sensors for detecting a pump pressure can be omitted, and the cost of the hydraulic system can be reduced further.

<Others>

It is to be noted that, although, in the embodiments described above, the spring 15*b* is provided in order to stabilize action of the unloading valve 15, the spring 15*b* may not be provided. Further, without providing the spring 15*b* in the unloading valve 15, the value of "ΔPsd+spring force" may be calculated as a target differential pressure in the controller 70, 90 or 95.

In the second embodiment, a pump regulation device that performs load sensing control may be used similarly as in the first embodiment, and in the first embodiment, a pump regulation device that calculates the sum of demanded flow rates of the plurality of directional control valves 6*a*, 6*b* and 6*c* to perform flow rate control may be used similarly as in the second embodiment.

Furthermore, although the embodiments described hereinabove are directed to the case in which the construction machine is a hydraulic excavator having a crawler belt on the lower track structure, the construction machine may otherwise be a different construction machine such as, for example, a wheel type hydraulic excavator or a hydraulic crane. Also in this case, similar advantages are achieved.

DESCRIPTION OF REFERENCE CHARACTERS

1: Prime mover
2: Variable displacement main pump (hydraulic pump)
3*a* to 3*h*: Actuator
4: Control valve block
5: Hydraulic fluid supply line (main)
6*a* to 6*c*: Directional control valve (control valve device)
7*a* to 7*c*: Pressure compensating valve (control valve device)
9*a* to 9*c*: Shuttle valve (highest load pressure detection device)
11: Regulator (pump regulation device)
14: Relief valve
15: Unloading valve
15*a*, 15*c*: Pressure receiving portion
15*b*: Spring
21, 22: Solenoid proportional pressure reducing valve
30: Pilot pump
31*a*: Hydraulic fluid supply line (pilot)
32: Pilot relief valve
40, 41*a*1 to 41*h*2, 42: Pressure sensor
40*a* to 40*c*: Pressure sensor
60*a* to 60*c*: Operation lever device
70, 90, 95: Controller

The invention claimed is:

1. A hydraulic drive system for a construction machine, comprising:

a variable displacement hydraulic pump;

a plurality of actuators driven by hydraulic fluid delivered from the hydraulic pump;

a control valve device that distributes and supplies the hydraulic fluid delivered from the hydraulic pump to the plurality of actuators;

a plurality of operation lever devices that instruct driving directions and speeds of the plurality of actuators;

a pump regulation device that controls a delivery flow rate of the hydraulic pump so as to deliver the delivery flow rate according to input amounts of operation levers of the plurality of operation lever devices;

an unloading valve that discharges the hydraulic fluid of a hydraulic fluid supply line of the hydraulic pump to a tank when a pressure of the hydraulic fluid supply line increases and exceeds a set pressure equal to a sum of a highest load pressure of the plurality of actuators and at least a target differential pressure; and a controller that controls the control valve device, wherein the control valve device includes:

a plurality of directional control valves that are individually shifted by the plurality of operation lever devices and associated with the plurality of actuators to adjust the driving directions and the speeds of the respective actuators, and a plurality of pressure compensating valves arranged in downstream sides of the plurality of directional control valves for controlling pressures in downstream sides of meter-in openings of the plurality of directional control valves such that the pressures in the downstream sides of the meter-in openings of the plurality of directional control valves becomes equal to the highest load pressure, and the controller is configured to:

calculate demanded flow rates for the plurality of actuators and the meter-in openings of the plurality of directional control valves based on the input amounts of the operation levers of the plurality of operation lever devices, calculate a meter-in pressure loss of a particular directional control valve among the plurality of directional control valves based on the meter-in openings and the demanded flow rates, and output the pressure loss as the target differential pressure to control the set pressure of the unloading valve.

2. The hydraulic drive system for a construction machine according to claim 1, wherein the controller is configured to select, as the meter-in pressure loss of the particular directional control valve, a maximum value of the meter-in pressure losses of the plurality of directional control valves and output the pressure loss as the target differential pressure to control the set pressure of the unloading valve.

3. The hydraulic drive system for a construction machine according to claim 1, further comprising:

a highest load pressure detection device that detects the highest load pressure of the plurality of actuators, wherein the controller is configured to calculate, as the meter-in pressure loss of the particular directional control valve, a meter-in pressure loss of a directional control valve corresponding to the actuator of the highest load pressure detected by the highest load pressure detection device among the plurality of directional control valves and output the pressure loss as the target differential pressure to control the set pressure of the unloading valve.

4. The hydraulic drive system for a construction machine according to claim 1, further comprising:

a highest load pressure detection device that detects the highest load pressure of the plurality of actuators; and a pressure sensor that detects the pressure of the hydraulic pump, wherein the controller is configured to calculate a command value for making the pressure of the hydraulic pump detected by the pressure sensor equal to a sum of the highest load pressure detected by the highest load pressure detection device and the target differential pressure and output the command value to the pump regulation device to control the delivery flow rate of the hydraulic pump.

5. The hydraulic drive system for a construction machine according to claim 1, wherein the controller is configured to calculate a sum of the demanded flow rates of the plurality of actuators based on the input amounts of the operation levers of the plurality of operation lever devices, calculate a command value for making the delivery flow rate of the hydraulic pump equal to the sum of the demanded flow rates and output the command value to the pump regulation device to control the delivery flow rate of the hydraulic pump.

* * * * *